US011149376B2

(12) United States Patent
Cha et al.

(10) Patent No.: US 11,149,376 B2
(45) Date of Patent: Oct. 19, 2021

(54) WASHING MACHINE FOR ADJUSTING OPERATION BASED ON INJECTED DETERGENT AND METHOD FOR CONTROLLING THE SAME

(71) Applicant: LG Electronics Inc., Seoul (KR)

(72) Inventors: Seung Chul Cha, Gyeonggi-do (KR); Bon Kwon Koo, Seoul (KR); Hyun Ji Park, Seoul (KR); Sang Hyun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 115 days.

(21) Appl. No.: 16/665,436

(22) Filed: Oct. 28, 2019

(65) Prior Publication Data

US 2021/0062397 A1 Mar. 4, 2021

(30) Foreign Application Priority Data

Sep. 2, 2019 (KR) ..... 10-2019-0108418

(51) Int. Cl.

| | |
|---|---|
| ***D06F 39/08*** | (2006.01) |
| ***D06F 34/22*** | (2020.01) |
| ***D06F 34/18*** | (2020.01) |
| ***D06F 33/00*** | (2020.01) |
| ***D06F 39/02*** | (2006.01) |

(52) U.S. Cl.
CPC ..... *D06F 39/086* (2013.01); *D06F 33/00* (2013.01); *D06F 34/18* (2020.02); *D06F 34/22* (2020.02); *D06F 39/02* (2013.01)

(58) Field of Classification Search
CPC ..... D06F 39/086
See application file for complete search history.

(56) References Cited

U.S. PATENT DOCUMENTS

2008/0256723 A1 10/2008 Kim et al.
2018/0171529 A1 6/2018 Xu et al.

FOREIGN PATENT DOCUMENTS

JP 2014210123 11/2014

*Primary Examiner* — Jason Y Ko
(74) *Attorney, Agent, or Firm* — Fish & Richardson P.C.

(57) ABSTRACT

A washing machine capable of operating in an IoT environment through a 5G communication network and estimating the type and amount of injected detergent through a neural network model created according to machine learning, and a method of controlling the washing machine, are provided. The washing machine may include a first tub into which laundry is loaded, a water supplier configured to supply washing water to the first tub, a detergent detection sensor configured to detect first conductivity and first turbidity of the washing water, and a processor configured to determine a washing cycle of the washing machine based on detected information.

20 Claims, 18 Drawing Sheets

WASHING MACHINE FOR ADJUSTING OPERATION BASED ON INJECTED DETERGENT AND METHOD FOR CONTROLLING THE SAME

CROSS-REFERENCE TO RELATED APPLICATION

This application claims benefit of priority to Korean Application No. 10-2019-0108418, filed on Sep. 2, 2019, the entire disclosure of which is incorporated herein by reference.

BACKGROUND

1. Technical Field

The present disclosure relates to a washing machine that adjusts operation thereof based on injected detergent and a control method thereof. More specifically, the present disclosure relates to a washing machine that adjusts a washing cycle and a rinsing cycle performed therein by estimating the type and amount of detergent injected into the washing machine using a detergent detection sensor, and a method of controlling the laundry apparatus.

2. Description of Related Art

When laundry to be washed is loaded into a washing machine, the washing machine supplies water and detergent, and washes contaminants from the laundry using the movement of the dynamic components therein.

In order to clean the laundry, a suitable type of detergent should be injected in a suitable amount based on the amount of the laundry and the operation of the washing machine.

However, most users do not exactly know the suitable type or amount of detergent based on the amount of the laundry and the operation of the washing machine. Due to habit, the users select any type of detergent, and add any amount of detergent.

In this case, when the washing machine performs a general washing cycle irrespective of the type and amount of detergent, the washing of laundry may not be effectively performed.

In this regard, in US Patent Application Publication No. 2008-0256723, entitled "Washing Machine for Guiding Input Amount of Detergent and Method for Guiding Input Amount of Detergent," disclosed is a method and device for sensing the amount of clothes loaded into a washing machine, determining the suitable amount of detergent to be inputted based on the sensed amount of clothes, and guiding the amount of detergent to be inputted, through a display.

In the above-described disclosure, the amount of clothes and the amount of detergent may be displayed on the display so as to assist a user in inputting a suitable amount of detergent. However, there is a limit in that, even if more or less detergent is inputted, the washing machine is not able to sense the inputted amount, and thus performs the same cleaning operation.

In Japanese Patent Application Publication No. 2014-210123, entitled "Washing Machine," disclosed is a washing machine which detects the temperature and conductivity of a liquid supplied to the outer tub thereof, and sets the time of a detergent dissolution process, a rinsing time, or the number of times of rinsing based on the type of detergent or the temperature of water determined based on the detection result, so that the whole operation time can be shortened.

In the above-described disclosure, the information that can be used to determine the type of detergent is limited to the information acquired from a conductivity sensor. Therefore, there is a limit in that there is a high possibility that the type of detergent will be misclassified, since it is not possible to distinguish a case in which there is no detergent and a case in which liquid detergent has been injected, and since, when a large amount of liquid detergent is injected, the liquid detergent may be determined as powder detergent.

In addition, in the above-described disclosure, there is a limit in that, since sensor data acquired from the sensor is transmitted using an analog signal, disturbance of the signal may occur due to noise around the product.

Meanwhile, in US Patent Application Publication No. 2018-0171529, entitled "Method for Controlling Flocculation Washing Machine and Washing Machine," disclosed is a washing machine control method in which the concentration of detergent is obtained by sensing the amount of water injected into the washing machine and the amount of detergent injected by an automatic detergent dispenser, and the number of times of flocculation circulation corresponding to the concentration of the detergent and the dose amount of flocculant corresponding to each flocculation circulation are determined.

Although the above-described disclosure adopts a method of adjusting the operation of the washing machine based on the injected amount of detergent, there is a limit in that the method is applicable only when the amount of detergent actually injected is capable of being automatically adjusted and sensed using the automatic detergent dispenser.

In order to overcome the limits described above, there is a need to provide a solution for more accurately detecting the type and amount of detergent even when the user directly selects and adds detergent, thereby allowing the operation of the washing machine to be adjusted.

The above-described related art is technical information that the inventor holds for deriving the present disclosure or is acquired in the derivation process of the present disclosure, and is not necessarily a known technology disclosed to the general public before the application of the present disclosure.

SUMMARY OF THE INVENTION

The present disclosure is directed to addressing a shortcoming associated with some related art in which a user who uses a washing machine may add too much or too little detergent or may add a wrong type of detergent, and thus proper washing is not achieved.

The present disclosure is further directed to addressing a shortcoming associated with some related art in which, since it is not possible to accurately know the amount of detergent required based on the type and amount of laundry, the washing machine is operated in the same manner even when too much or too little detergent is injected, and the washing is thus not performed properly.

The present disclosure is still further directed to addressing a shortcoming associated with some related art in which, since only a conductivity value is used, it is not possible to accurately determine the type of detergent to be injected into the washing machine.

The present disclosure is still further directed to addressing a shortcoming associated with some related art in which, since a sensor in a washing machine transmits an analog signal, a disturbed signal may be provided.

The present disclosure is still further directed to addressing a shortcoming associated with some related art in which it is not possible to determine whether the injected detergent has been completely removed through the rinsing operation, and it is not possible to known how much the rinsing operation should be performed in order to thoroughly the detergent.

The present disclosure is still further directed to addressing a shortcoming associated with some related art in which a user who uses a washing machine does not recognize the problems associated with the manner that he or she uses detergent and drives the washing machine.

An embodiment of the present disclosure may provide a washing machine configured to detect the conductivity and turbidity of washing water, determine the type and amount of detergent injected in the washing water on the basis of the detected conductivity and turbidity, and adjust a washing operation based on the injected detergent so that a suitable operation method of the washing machine can be determined.

According to this embodiment of the present disclosure, the conductivity and turbidity of the washing water may be corrected based on the temperature of the washing water.

Another embodiment of the present disclosure may provide a washing machine further including a weight sensor configured to detect an amount of laundry so as to adjust a washing operation further considering the amount of laundry detected using the weight sensor in addition to the type and amount of the detergent estimated on the basis of the conductivity and turbidity of the washing water.

According to still another embodiment of the present disclosure, the washing machine may be configured such that different rinsing cycles are determined based on the type of detergent determined on the basis of the conductivity and turbidity of the washing water, and the determined rinsing cycle is adjusted based on the state of rinsing water estimated based on the conductivity and turbidity of the rinsing water.

According to an embodiment of the present disclosure, a washing machine configured to adjust the operation thereof based on injected detergent may include a first tub into which laundry is loaded, a water supplier configured to supply water to the first tub, a detergent detection sensor configured to detect a first conductivity and a first turbidity of the washing water supplied to the first tub, and a processor configured to determine a washing cycle of the washing machine.

Here, the processor may be configured to determine a type and amount of the detergent injected in the washing water based on the detected first conductivity and first turbidity, and to determine the washing cycle based on the determined type and amount of the detergent.

The detergent detection sensor may be further configured to detect a first temperature of the washing water and correct the first conductivity and first turbidity based on the detected first temperature, and the processor may be further configured to determine the type and amount of the detergent injected in the washing water based on the first conductivity and the first turbidity corrected based on the first temperature.

According to another embodiment of the present disclosure, a washing machine may further include a weight sensor configured to detect an amount of laundry loaded into the first tub, and the processor may be further configured to determine the washing cycle further considering the amount of the laundry in addition to the determined type and amount of the detergent.

Here, the processor may be further configured to generate a signal requesting additional injection of detergent when the determined amount of the detergent is less than a threshold, and the threshold may vary based on the amount of the laundry detected by the weight sensor.

According to still another embodiment of the present disclosure, a washing machine may further include a second tub configured to accommodate the first tub, the first tub may be rotatably coupled to the second tub, the first tub having an opening in a surface thereof, and the detergent detection sensor may be coupled to the second tub so as to come into contact with the washing water in the second tub.

Here, the processor may be further configured to output estimated values of the type and amount of the detergent injected in the washing water by applying the detected first conductivity and first turbidity to a first neural network model, and the first neural network model may be a neural network model that has been previously trained using training data including, as labels, conductivity and turbidity measured in a solution and a type and amount of detergent injected in the solution.

According to still another embodiment of the present disclosure, the processor may be further configured to determine a rinsing cycle based on whether the determined type of detergent is liquid detergent, after the washing cycle is completed.

Here, the detergent detection sensor may be configured to detect a second conductivity and a second turbidity of the rinsing water in the second tub during the rinsing cycle, and the processor may be further configured to estimate a state of the rinsing water based on the second conductivity and the second turbidity, and adjust the rinsing cycle based on the estimated state of the rinsing water.

In addition, the detergent detection sensor may be configured detect a third conductivity and a third turbidity of the rinsing water during the adjusted rinsing cycle, and the processor may be further configured to determine a rinsing performance based on a difference between the second conductivity and the third conductivity and a difference between the second turbidity and the third turbidity.

In addition, the processor may be further configured to estimate a degree of rinsing after the rinsing cycle is completed based on the determined rinsing performance, transmit information on the estimated degree of rinsing to a user terminal, and correct the rinsing cycle based on a signal received from the user terminal in response to the information on the estimated degree of rinsing.

A method of controlling a washing machine based on injected detergent according to an embodiment of the present disclosure may include detecting an amount of laundry loaded into a first tub of the washing machine, supplying washing water to the first tub, detecting a first conductivity and a first turbidity of the washing water, determining a type and amount of the detergent injected in the washing water based on the first conductivity and the first turbidity, and determining a washing cycle on the basis of the determined type and amount of detergent.

According to another embodiment of the present disclosure, the washing machine control method may further include detecting a first temperature of the washing water, and correcting the first conductivity and the first turbidity based on the detected first temperature, and the determining of the type and amount of the detergent may include determining the type and amount of the detergent injected in the washing water on the basis of the first conductivity and the first turbidity corrected based on the first temperature.

According to another embodiment of the present disclosure, the washing machine control method may further include generating a signal requesting additional injection of detergent when the amount of the detergent determined in the determining of the type and amount of the detergent is less than a threshold, and the threshold may vary on the basis of the amount of the laundry.

Here, the determining of the type and amount of the detergent may include outputting estimated values of the type and amount of the detergent injected in the washing water by applying the detected first conductivity and first turbidity to a first neural network model, and the first neural network model may be a neural network model that has been previously trained using training data including, as labels, conductivity and turbidity measured in a solution and a type and amount of detergent injected in the solution.

According to still another embodiment of the present disclosure, after the determining of the washing cycle, the washing machine control method may further include draining the washing water, and determining a rinsing cycle based on whether the type of detergent determined in the determining of the type and amount of the detergent is liquid detergent.

According to still another embodiment of the present disclosure, after the determining of the rinsing cycle, the washing machine control method may further include supplying rinsing water into the first tub, detecting a second conductivity and a second turbidity of the rinsing water during the rinsing cycle, estimating a state of the rinsing water on the basis of the second conductivity and the second turbidity, and adjusting the rinsing cycle based on the estimated state of the rinsing water.

According to still another embodiment of the present disclosure, after the adjusting of the rinsing cycle, the washing machine control method may further include detecting a third conductivity and a third turbidity of the rinsing water during the adjusted rinsing cycle, and determining a rinsing performance based on the third conductivity and the third turbidity.

According to still another embodiment of the present disclosure, after the determining of the rinsing performance, the washing machine control method may further include estimating a degree of rinsing after the rinsing cycle is completed based on the determined rinsing performance, transmitting information on the estimated degree of rinsing to a user terminal, and correcting the rinsing cycle based on a signal received from the user terminal in response to the information on the estimated degree of rinsing.

According to still another embodiment, the washing machine control method may further include accumulating washing machine operation information obtained while the washing machine is performing a washing cycle, a rinsing cycle, and a dehydration cycle, and outputting a suggestion relating to at least one of the amount or the type of detergent, on the basis of the accumulated washing machine operation information.

Here, the washing machine operation information may include at least one of a washing machine operation time in each cycle, the amount and type of detergent injected into the washing water, or the amount of the laundry.

A computer-readable recording medium for controlling the washing machine according to an embodiment of the present disclosure may be a computer-readable recording medium in which a computer program configured to execute any one of the above-described methods is stored.

Another embodiment of the present disclosure may provide a washing machine comprising a first tub into which laundry is loaded, a water supplier configured to supply washing water to the first tub, a weight sensor configured to detect an amount of laundry loaded into the first tub, a detergent detection sensor configured to detect a first conductivity and a first turbidity of the washing water after the washing water is supplied to the first tub, and a processor configured to determine a first washing cycle for the washing machine based on an amount of laundry loaded into the first tub, wherein the processor is further configured to determine a type and amount of detergent injected in the washing water based on the detected first conductivity and first turbidity of the washing water, and determine a second washing cycle for the washing machine based on the determined type and amount of the detergent.

Another embodiment of the present disclosure may provide a method of controlling a washing machine, the method comprising, detecting an amount of laundry loaded into a first tub of the washing machine, supplying washing water to the first tub, determining, by a processor, a first washing cycle for the washing machine based on the detected amount of laundry, detecting, by a detergent detection sensor, a first conductivity and a first turbidity of the washing water after the washing water is supplied to the first tub, determining, by the processor, a type and amount of detergent injected in the washing water based on the detected first conductivity and first turbidity of the washing water, and determining, by the processor, a second washing cycle for the washing machine based on the determined type and amount of the detergent.

Other aspects, features, and advantages other than those described above will become apparent from the following drawings, claims, and detailed description of the present disclosure.

According to embodiments of the present disclosure, it is possible to provide a washing machine and a method for controlling the same in which, even if a user using the washing machine adds too much or too little detergent or adds a wrong type of detergent, the washing machine is capable of detecting the amount or type of the detergent, so that suitable washing can be performed.

When too much or too little detergent is injected, the washing machine according to an embodiment of the present disclosure is capable of detecting the amount of detergent and changing the operation of the washing machine, so that effective washing can be performed.

In addition, the washing machine according to embodiments of the present disclosure is capable of performing a suitable washing cycle and rinsing cycle by detecting the conductivity, turbidity, and temperature of the washing water and rinsing water using the detergent detection sensor, and detecting the type and amount of detergent on the basis of the detected conductivity, turbidity, and temperature.

The washing machine according to embodiments of the present disclosure is capable of providing a correct signal to the washing machine processor by converting an analog signal detected by a sensor in the washing machine into a digital signal and transmitting the digital signal to the washing machine processor.

The washing machine according to embodiments of the present disclosure is capable of performing effective rinsing by determining the type and amount of detergent injected in the wash water, and allowing the rinsing method when the detergent is liquid detergent and the rinsing method when the detergent is powder detergent to be different from each other.

The washing machine according to embodiments of the present disclosure is capable of performing effective rinsing by detecting the type and amount of detergent remaining in the rinsing water during the rinsing cycle, and adjusting the rinsing time and rinsing operation on the basis of the detected type and amount of detergent.

The washing machine according to embodiments of the present disclosure is capable of indicating what is to be corrected by the user using the washing machine by analyzing how the user uses detergent and how the user operates the washing machine.

The effects of the present disclosure are not limited to the effects mentioned above, and other effects not mentioned may be clearly understood by those skilled in the art from the following description.

BRIEF DESCRIPTION OF THE DRAWINGS

The above and other aspects, features, and advantages of the present disclosure will become apparent from the detailed description of the following aspects in conjunction with the accompanying drawings, in which.

DETAILED DESCRIPTION

Figure 1:
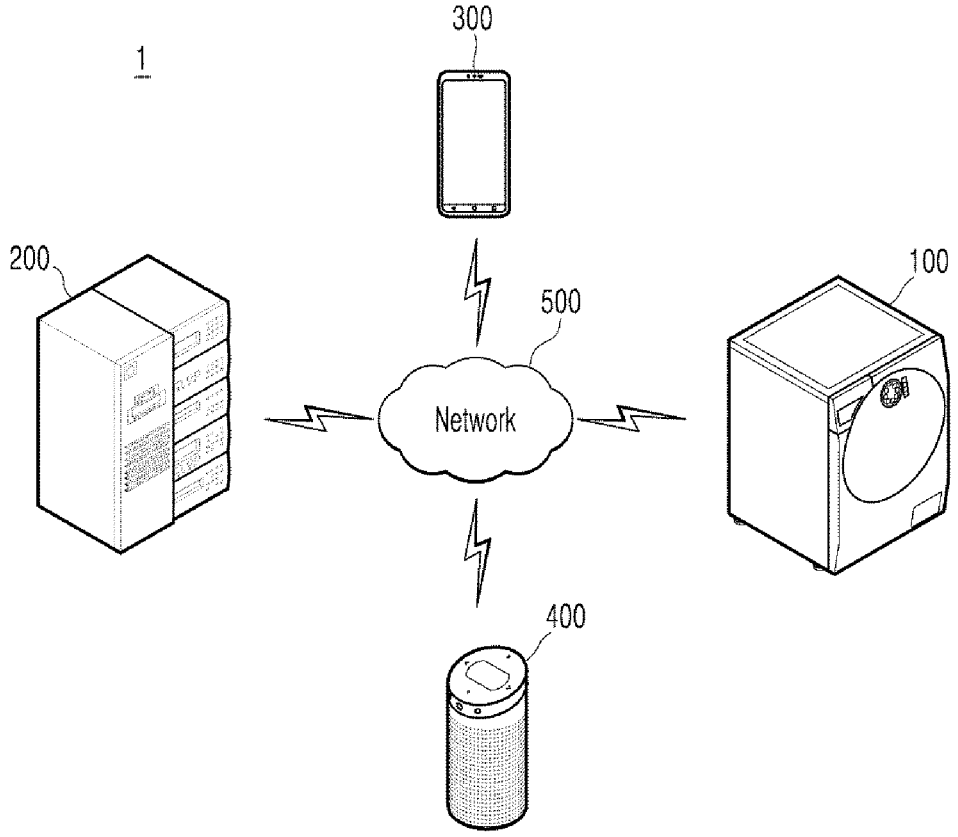
FIG. 1 is an exemplary view illustrating a system environment in which a washing machine, a user terminal, an artificial intelligence speaker, and an external server are connected to each other according to an embodiment of the present disclosure.

Advantages and features of the present disclosure and methods for achieving them will become apparent from the descriptions of aspects hereinbelow with reference to the accompanying drawings. However, the description of particular example embodiments is not intended to limit the present disclosure to the particular example embodiments disclosed herein, but on the contrary, it should be understood that the present disclosure is to cover all modifications, equivalents and alternatives falling within the spirit and scope of the present disclosure. The example embodiments disclosed below are provided so that the present disclosure will be thorough and complete, and also to provide a more complete understanding of the scope of the present disclosure to those of ordinary skill in the art. In the interest of clarity, not all details of the relevant art are described in detail in the present specification in so much as such details are not necessary to obtain a complete understanding of the present disclosure.

The terminology used herein is used for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or groups thereof. Furthermore, these terms such as "first," "second," and other numerical terms, are used only to distinguish one element from another element. These terms are generally only used to distinguish one element from another.

Hereinafter, embodiments of the present disclosure will be described in detail with reference to the accompanying drawings. Like reference numerals designate like elements throughout the specification, and overlapping descriptions of the elements will not be provided.

Although a washing machine according to embodiments of the present disclosure may include, for example, a washing machine, a dish washer, and an industrial washer, the embodiments will be described with reference to a washing machine mainly used at home for convenience of description.

FIG. 1 is an exemplary view illustrating a system environment in which a washing machine, a user terminal, an artificial intelligence speaker, and an external server are connected to each other according to an embodiment of the present disclosure.

As illustrated in FIG. 1, a washing machine 100 according to an embodiment of the present disclosure may operate in a driving environment including a user terminal 300 capable of communicating with the washing machine 100, an external server 200, an artificial intelligence speaker 400, and a network 500 connecting these components to each other.

The washing machine 100 may include a communication device, an input interface, a sensor including a detergent detection sensor, an output interface including a display, a storage including memory, a power supply, a washing unit including physical devices such as washing tub required for washing, and a controller including a washing machine MCU.

The controller of the washing machine 100 may include any kind of device capable of processing data like a processor (for example, an MCU). Here, the "processor" may refer to a data processing device embedded in hardware having, for example, a circuit physically structured to perform a function represented by codes or instructions included in a program.

Examples of data processing devices embedded in hardware as described above may include processing devices, such as a microprocessor, a central processing unit (CPU), a processor core, a multiprocessor, and an application-specific integrated device (ASIC), and a field programmable gate array (FPGA), but the scope of the present disclosure is not limited thereto.

The communication device of the washing machine 100 may transmit a value received by the detergent detection sensor or various pieces of information related to the operation of the washing machine to the external server 200 through a wired or wireless network 500, and the external server 200 may transmit information about laundry detergent and various pieces of washing information to the washing machine 100, the user terminal 300, and the artificial intelligence speaker 400.

The communication device of the washing machine 100 may cooperate with the network 500 so as to provide a communication interface required to provide transmission/reception signals among the artificial intelligence speaker 400, the user terminal 300, and/or the external server 200 in the form of packet data. The communication device may include a receiver, a transmitter, or a transceiver.

In addition, the communication device of the washing machine 100 may support various kinds of object-to-object intelligent communication (such as Internet of things (IoT), Internet of everything (IoE), and Internet of small things (IoST)), and may support communication such as machine to machine (M2M) communication, vehicle to everything communication (V2X), and device to device (D2D) communication.

The washing machine 100 may extract detergent information, and may determine an optimal washing operation method using big data, artificial intelligence (AI) algorithms and/or machine learning algorithms in a 5G environment connected for the IoT.

The artificial intelligence speaker 400 may recognize a voice command of a user, and may transmit the voice command to one of the washing machine 100, the external server 200, or the user terminal 300. In addition, the artificial intelligence speaker 400 may receive information from one of the washing machine 100, the external server 200, or the user terminal 300, and may transmit the information to the user by voice.

Although FIG. 1 illustrates the artificial intelligence speaker 400 by way of example, in an actual use environment, in addition to the artificial intelligence speaker, a communication device capable of recognizing other voices, such as an artificial intelligence TV or an artificial intelligence refrigerator may be used. The user may transmit a command by voice through these devices, or may receive a voice response.

In the present embodiment, the user terminal 300 may be a desktop computer, a smartphone, a notebook, a tablet PC, a smart TV, a cell phone, a personal digital assistant (PDA), a laptop, a media player, a micro server, a global positioning system (GPS) device, an electronic book terminal, a digital broadcast terminal, a navigation device, a kiosk, an MP3 player, a digital camera, a home appliance, and other mobile or immobile computing devices operated by the user, but is not limited thereto.

Further, the user terminal 300 may be a wearable terminal such as a clock, eyeglasses, a hair band, and a ring having a communication function and a data processing function. However, the user terminal 300 is not limited thereto, and all kinds of terminals capable of web-browsing may also be applied to the present disclosure.

Meanwhile, although FIG. 1 separately illustrates the user terminal 300 illustrated as a smartphone and the artificial intelligence speaker 400, a user terminal may generally include an artificial intelligence speaker that interacts with the user.

The external server 200 may be a database server that provides big data required for applying various artificial intelligence algorithms and data for operating the washing machine 100. In addition, the external server 200 may include a web server or an application server, which allows the user to remotely control the operation of the washing machine 100 using a washing machine driving application or a washing machine driving web browser installed in the user terminal 300.

Meanwhile, although the external server 200 may be equipped with an artificial neural network for processing various pieces of information, such an artificial neural network may also be provided in the washing machine 100 itself.

Figure 2:
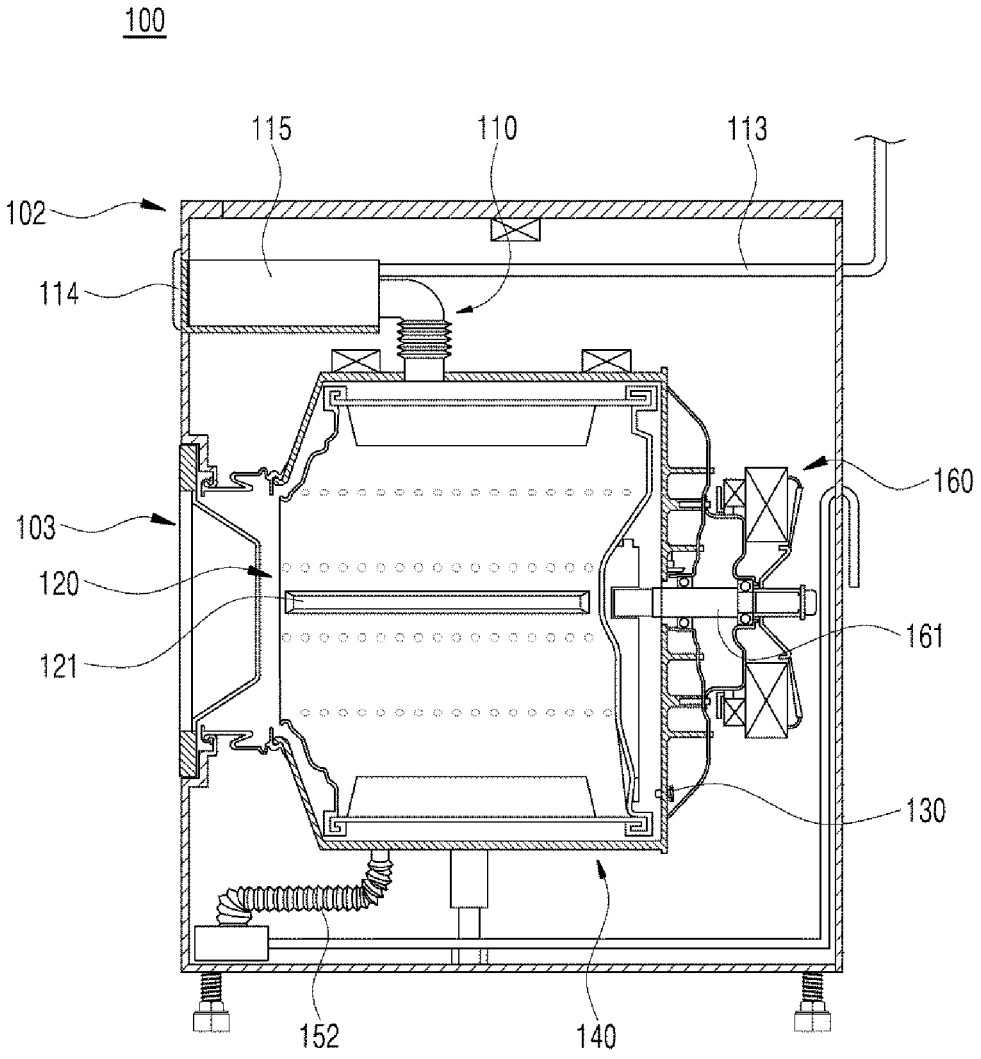
FIG. 2 is a cross-sectional view illustrating a washing machine configured to adjust the operation thereof based on injected detergent according to an embodiment of the present disclosure.

FIG. 2 is a cross-sectional view illustrating a washing machine configured to adjust the operation thereof based on injected detergent according to an embodiment of the present disclosure.

The washing machine 100 may include a cabinet 102 forming an exterior of the washing machine 100, a water supplier 110 configured to supply washing water for washing, a first tub 120 disposed inside the cabinet 102 and into which laundry is inserted, a detergent detection sensor 130 configured to detect physical properties of the washing water, a second tub 140 configured to accommodate the first tub 120, and a motor 160 configured to rotate the first tub 120.

The cabinet 102 has a front surface, side surfaces, a rear surface, a top surface, and a bottom surface that form the exterior of the washing machine 100, and a door 103 configured to open and close an inlet port of the first tub 120 may be formed in the front surface.

In addition, a control panel 114 may be disposed on the upper end of the front surface of the cabinet 102. The control panel 114 may be provided with a plurality of buttons for manipulating the operation of the washing machine 100, and may include a display for displaying the operating state of the washing machine 100.

The water supplier 110 supplying the washing water may include a water supply pipe 113 and a detergent drawer 115. The detergent drawer 115 is provided on the side of the control panel 114, and may have a portion configured to store detergent and a portion exposed to the front side which are integrally formed. The portion exposed to the front side may serve as a handle so as to allow the user to open and close the drawer 115.

The water supplied through the water supply pipe 113 is mixed with the detergent while passing through the detergent drawer 115, thereby being turned into washing water, and the washing water may be supplied to the first tub 120 containing the laundry through the second tub 140. Washing water used to perform washing in the first tub 120 and rinsing water used to perform rinsing may be discharged to the outside of the washing machine 100 through a drain pipe 152.

The first tub 120 is rotatably coupled to the second tub 140, and an opening is formed in the surface of the first tub 120 so that the liquid supplied to the second tub 140 may flow into the first tub 120, and the liquid in the first tub 120 may flow out to the second tub 140.

Here, a drum washing machine is taken as an example. Thus, the first tub 120 may be a drum, and the second tub 140 may be an outer tub that accommodates the drum. In another embodiment, the first tub 120 may be referred to as an inner tub, and the second tub 140 may be referred to as an outer tub.

A plurality of lifters 121 may be installed in the first tub 120 such that the laundry is caught so that the laundry can be rotated together with the first tub 120. The laundry may be caught by the lifters 121 to rotate together with the drum 120.

The motor 160 may be coupled to the first tub 120 through the rotation shaft 161, and the first tub 120 may be rotated according to the rotation of the motor 160.

In addition, although not illustrated in FIG. 2, a weight sensor may be disposed in the washing machine 100 to detect an amount of laundry loaded into the first tub 120. The weight sensor may be arranged to detect the weight of the first tub 120 in order to detect a change in the weight of the first tub 120, thereby detecting the amount of loaded laundry. The amount of laundry (load size) may be detected in various ways, such as before or after water is introduced into the tub, by load sensors or by sensors coupled with a motor, motor shaft or tub. Any sensor designed to detect an amount of laundry can be referred as a weight sensor.

Meanwhile, the weight sensor to be used herein may be configured to determine the weight of laundry loaded into the first tub on the basis of the time taken for the motor for rotating the first hub 120 to reach the normal rpm after a driving signal is inputted to the motor, rather than detecting the weight of the first tub 120.

Figure 3:
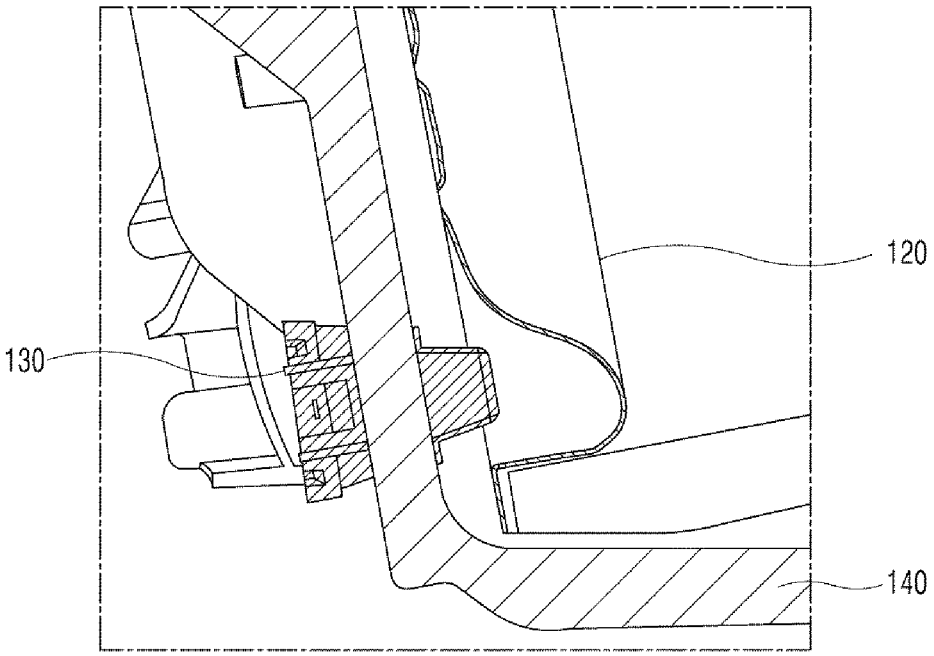
FIG. 3 is a view illustrating a coupling relationship between a detergent detection sensor and an outer tub of a washing machine, which are disposed inside a washing machine according to an embodiment of the present disclosure.

FIG. 3 is a view illustrating a coupling relationship between a detergent detection sensor and an outer tub of a washing machine, which are disposed inside a washing machine according to an embodiment of the present disclosure.

The washing machine 100 generally starts washing by loading laundry into a drum and introducing washing water into the drum. The washing machine 100 includes a movable inner tub (the first tub 120) into which laundry is loaded, and an outer tub (the second tub 140) surrounding the inner tub. Here, the first tub 120 may be rotatably coupled to the second tub 140, and an opening functioning as a water passage hole may be formed in the surface of the first tub 120. Water supplied to the first tub 120 flows out to the second tub 140 through a plurality of water passing holes formed in the first tub 120.

The washing machine 100 configured to adjust the operation thereof based on injected detergent according to an embodiment of the present disclosure may include a detergent detection sensor 130 coupled to the second tub 140. The detergent detection sensor 130 may be mounted at a location in the second tub 140 where water reaches.

In an embodiment, the detergent detection sensor 130 may be located near the bottom of the second tub 140 in which water remains for the longest time before being drained. In addition, the detergent detection sensor 130 may safely and stably operate by being coupled to the fixed second tub 140, rather than to the rotating first tub 120. The detergent detection sensor 130 may be detachably mounted on the second tub 140, and thus component replacement may be facilitated.

The detergent detection sensor 130 may penetrate through the second tub 140 to come into contact with the washing water in the second tub 140, and detect the physical properties of the washing water, such as the conductivity, turbidity, and temperature of the washing water.

The first tub 120 and the second tub 140 are connected to be in fluid communication such that the liquid in the first tub 120 flows out to the second tub 140, and the detergent detection sensor 130 is coupled to the second tub 140 to detect the physical properties of the liquid in the second tub 140. Thus, the detergent detection sensor 130 may detect the physical properties of the washing water and the rinsing water or the state of the rinsing water in the first tub 120.

A sensor of the washing machine 100 includes sensors for detecting elements necessary to determine the operation of the washing machine. In the present disclosure, unless otherwise specified, the sensor refers to the detergent detection sensor 130 that detects the physical properties of washing water or rinsing water.

The detergent detection sensor 130 may transmit, through a sensor MCU 132, an initial value of the detergent detection sensor measured when the water supply, drainage, and dehydration cycles are performed without detergent and laundry in order to check the operation state and the installation state of the washing machine when the washing machine 100 is installed in the user's home, and a value sensed in the final rinse when the user performs the washing and rinsing cycles, to a washing machine processor. The washing machine processor may store, in a storage, the initial value of the detergent detection sensor 130 and the value of the detergent detection sensor at the final rinsing as reference values.

In an embodiment of the present disclosure, the washing machine 100 may include a washing machine processor that receives a digital signal from the detergent detection sensor 130 to determine the degree of contamination of the washing tank. The processor may control the overall operation of the washing machine, including washing, rinsing, and dehydration cycles of the washing machine 100.

The processor may determine the type and amount of detergent injected in the washing water on the basis of the conductivity, turbidity, and temperature of the washing water detected by the detergent detection sensor 130, and may determine the operating method of the washing machine on the basis of the determined type and amount of detergent.

A more detailed configuration of the detergent detection sensor 130 will now be described in more detail with reference to FIGS. 4A to 4D.

FIGS. 4A to 4D are views illustrating a detergent detection sensor disposed inside a washing machine according to an embodiment of the present disclosure.

Figure 4A:
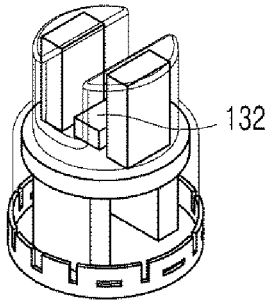
FIGS. 4A to 4D are views illustrating a detergent detection sensor disposed inside a washing machine according to an embodiment of the present disclosure.
Figure 4C:
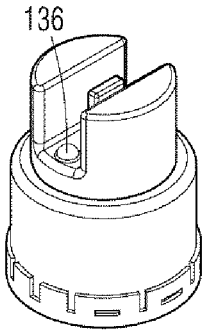
Figure 4B:
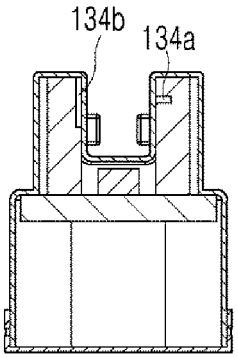
Figure 4D:
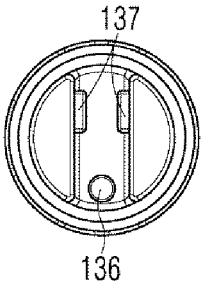

FIG. 4A illustrates a sensor MCU 132, FIG. 4B illustrates an optical sensor 134, FIG. 4C illustrates a temperature sensor 136, and FIG. 4D illustrates a conductivity sensor 137 of the detergent detection sensor 130 in more detail.

The detergent detection sensor 130 may include an optical sensor 134 configured to detect the transmittance of light in order to detect the turbidity of washing water, a temperature sensor 136 configured to detect the temperature of the washing water, a conductivity sensor 137 configured to detect the conductivity of the washing water, and a sensor MCU 132 including a correction algorithm for correcting the conductivity value and the transmittance value based on the temperature.

The detergent detection sensor 130 may be a unit obtained by integrating, into a single module, all the sensors capable of detecting conductivity, turbidity, and temperature, and a sensor MCU capable of correcting signals detected from the sensors and converting the detected signals into digital signals.

The detergent detection sensor 130 itself may include the sensor MCU 132, the analog signals detected by the sensors may be converted into digital signals through the sensor MCU 132, and the digital signals, rather than the analog signals, may be transmitted to the washing machine processor. Accordingly, it is possible to prevent signal disturbance, which may occur when analog signals are transmitted from the sensors.

The optical sensor 134 includes an LED 134*a* configured to emit light and a phototransistor 134*b* configured to detect the light emitted from the LED 134*a*. The light, emitted from the LED 134*a* of the optical sensor 134 in the state in which the second tub 140 is filled with the washing water, is transmitted to the phototransistor 134*b* through the washing water, and the turbidity of the washing water may be determined based on the light signal received by the phototransistor 134*b*.

Since the optical sensor 134 detects the degree of light transmission, the opposite concept to light transmission may be indicated as turbidity. The higher the transmittance of light in liquid, the lower the turbidity. Conversely, the lower the transmittance, the higher the turbidity.

Since the turbidity is increased when there is a lot of suspended matter in the liquid, it is possible to estimate the amount and type of detergent contained in the washing water on the basis of the turbidity measured using the optical sensor. However, since the turbidity may vary according to the temperature of the liquid even if the same amount of suspended matter is present, the measured turbidity may need to be corrected by the temperature for correct estimation.

The conductivity sensor 137 may measure the conductivity of the washing water by applying a predetermined voltage to two electrodes and detecting the magnitude of the flowing current. The conductivity sensor 137 may also be referred to as an electrode sensor. Since conductivity is affected by the presence of ions in the water and the total concentration of ions, the conductivity may indicate the amount of substances dissolved in the washing water.

Therefore, the type or amount of detergent dissolved in the washing water may be estimated based on the conductivity of the washing water. However, since the conductivity of a solution is influenced by the temperature of the solution in addition to the dissolved substance, the measured conductivity may need to be corrected on the basis of the temperature for accurate estimation.

The temperature sensor 136 is for measuring the temperature of the liquid, and the information on the temperature of the washing water is used not only for controlling the washing cycle, but also for correcting the conductivity and turbidity values in order to more accurately estimate the amount and type of detergent as described above.

As described above, the detergent detection sensor 130 may correct the turbidity measured by the optical sensor 134 and the conductivity measured by the conductivity sensor 137 on the basis of the temperature value measured by the temperature sensor 136.

That is, the detergent detection sensor 130 may transmit, to the washing machine processor, the turbidity and conductivity values to be measured at a standard temperature rather than the measured turbidity and conductivity values themselves, and thus the washing machine processor is capable of more accurately estimating the amount and type of detergent without being affected by the temperature.

In addition, the sensor MCU 132 included in the detergent detection sensor 130 may include an analog to digital converter (ADC) port, may receive measured signals from the optical sensor 134, the temperature sensor 136, and the conductivity sensor 137, and may convert the measured signals into digital signals.

If a conductivity value, a transmittance value, and a temperature are transmitted as analog signals when data is transmitted to the washing machine processor, there is a possibility that disturbed signals may be transmitted due to noise around the product, and thus a sensitivity error and a temperature correction error may occur.

In contrast, the detergent detection sensor 130 according to an embodiment of the present disclosure includes a conductivity sensor 137, an optical sensor 134, a temperature sensor 136, and a sensor MCU 132, which are integrated as a single module. Accordingly, the detergent detection sensor 130 may be configured to convert the analog signals measured by the sensors into digital signals, perform temperature correction on conductivity values and transmittance values required for detergent detection, and then output temperature-corrected digital values.

Accordingly, by transmitting, to the washing machine processor, the values of the detergent detection sensor that are temperature-corrected digital data, the detergent detection sensor 130 is capable of reducing the sensitivity error and the temperature correction error and increasing the accuracy of detected values, compared with the case in which analog signals are transmitted from existing sensors to a washing machine controller.

FIGS. 5A and 5B, FIGS. 6A and 6B, and FIGS. 7A and 7B are views illustrating signals detected based on the types of liquids in a washing machine according to an embodiment of the present disclosure.

Figure 5A:
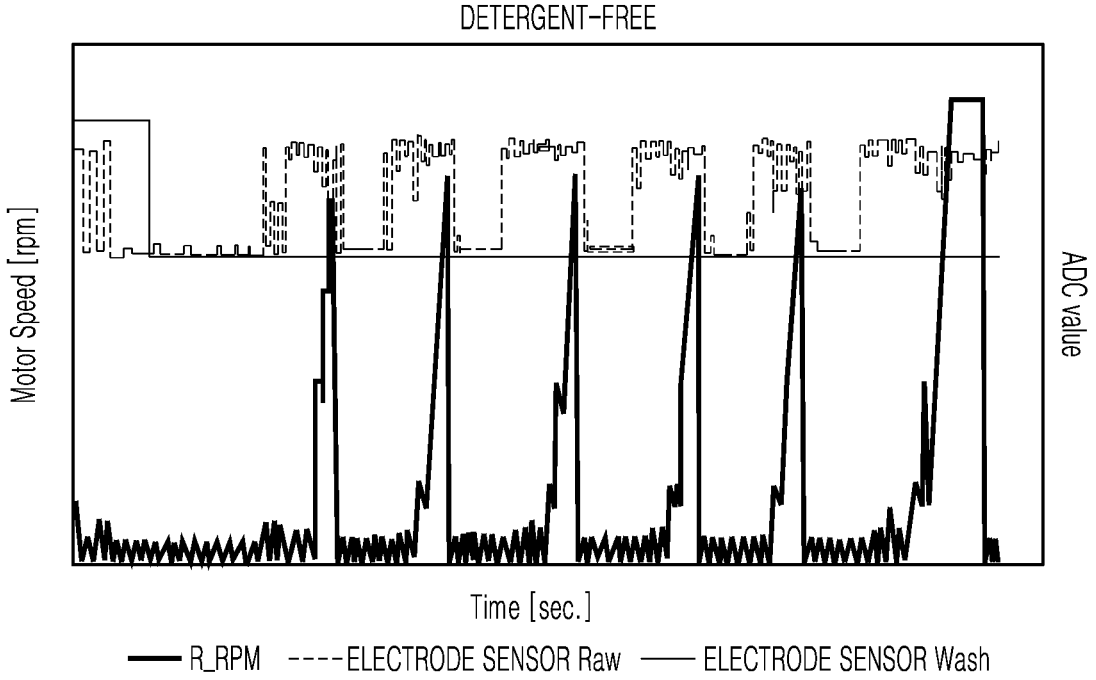
FIGS. 5A and 5B, FIGS. 6A and 6B, and FIGS. 7A and 7B are views illustrating signals detected based on the types of liquids in a washing machine according to an embodiment of the present disclosure.

FIG. 5A shows motor movement (R_RPM), detected conductivity (electrode sensor Raw), and corrected conductivity (electrode sensor Wash) during a washing cycle in the detergent-free case in which no detergent is added.

Figure 5B:
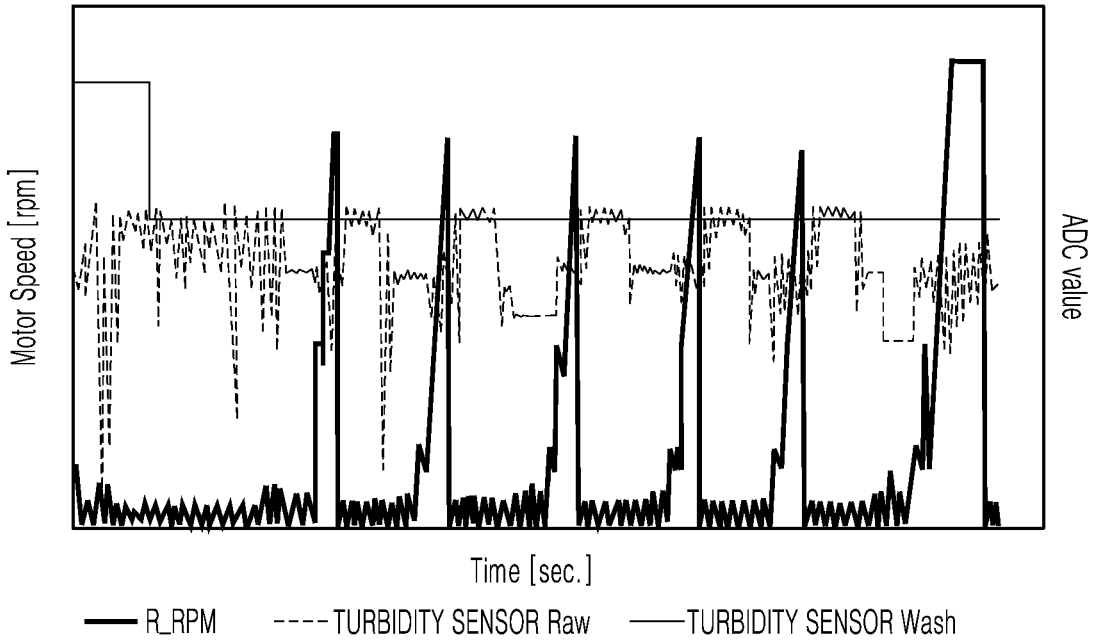

FIG. 5B shows motor movement (R_RPM), detected turbidity (turbidity sensor Raw), and corrected turbidity (turbidity sensor Wash) during a washing cycle in the detergent-free case in which no detergent is added.

In the detergent-free case, as shown in FIGS. 5A and 5B, it can be seen that the corrected conductivity and the corrected turbidity do not change significantly even after the washing cycle is started. The data obtained in the detergent-free case may be used as a criterion for confirming that the user has not added detergent and for determining whether rinsing is completed in the case of performing rinsing.

Figure 6A:
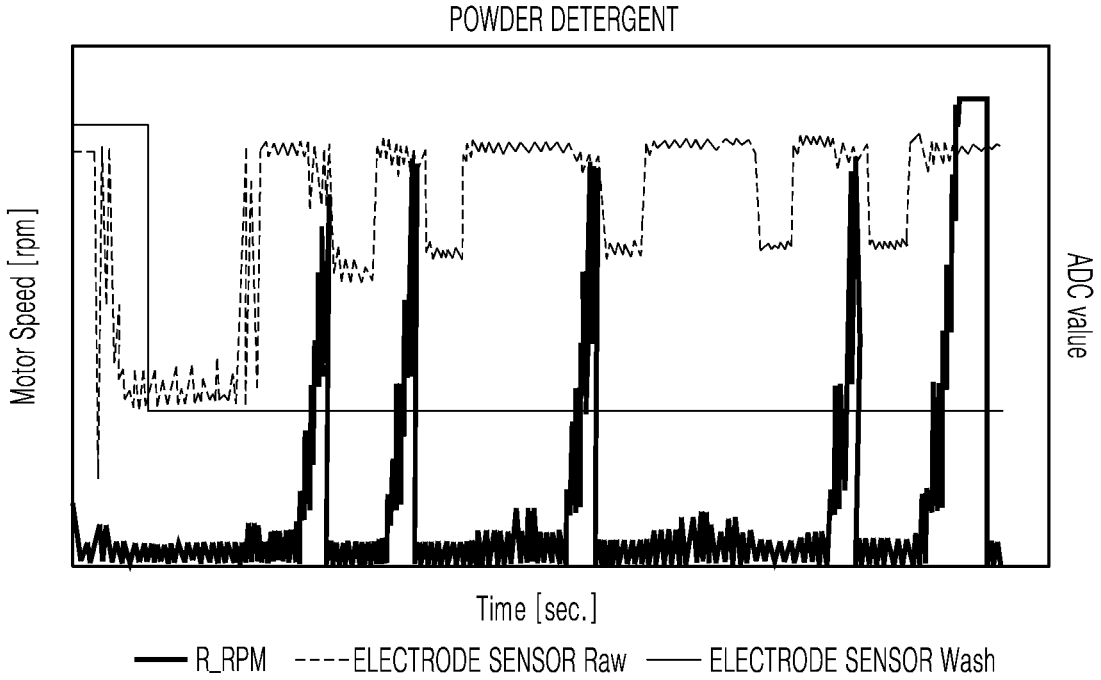

FIG. 6A shows motor movement (R_RPM), detected conductivity (electrode sensor Raw), and corrected conductivity (electrode sensor Wash) during a washing cycle in the case in which powder detergent is added.

Figure 6B:
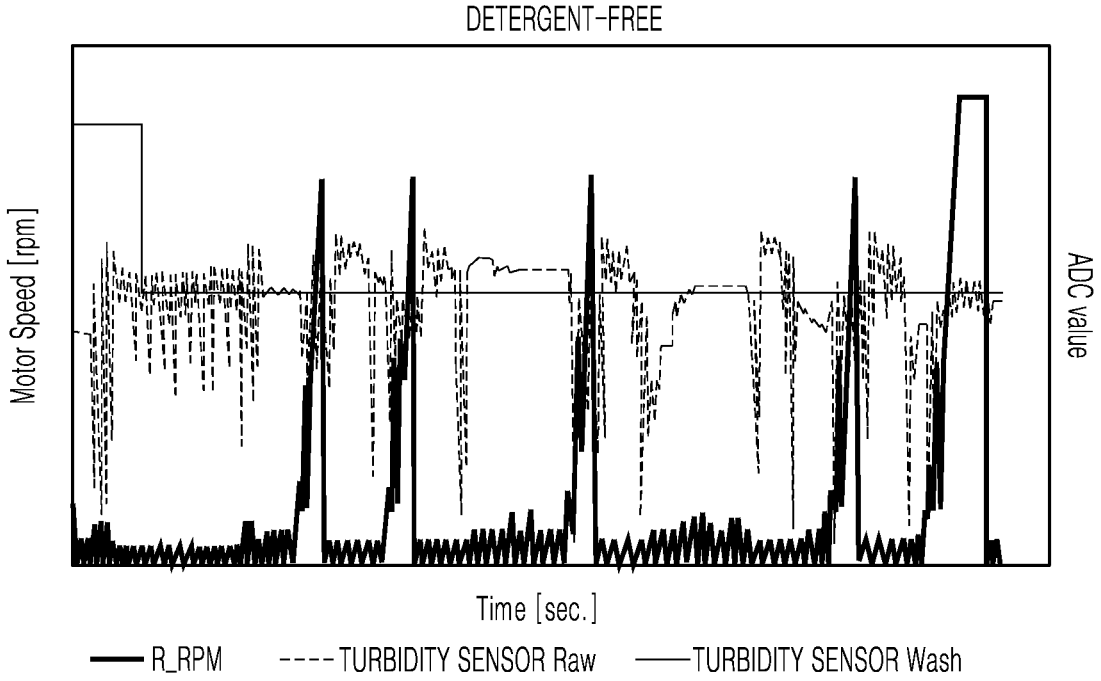

FIG. 6B shows motor movement (R_RPM), detected turbidity (turbidity sensor Raw), and corrected turbidity (turbidity sensor Wash) during a washing cycle in the case in which powder detergent is added.

In the case of the powder detergent, as shown in FIGS. 6A and 6B, it can be seen that the corrected conductivity value changes significantly after the washing cycle is started (in which the ADC value is significantly lowered), but the corrected turbidity does not change significantly.

Figure 7A:
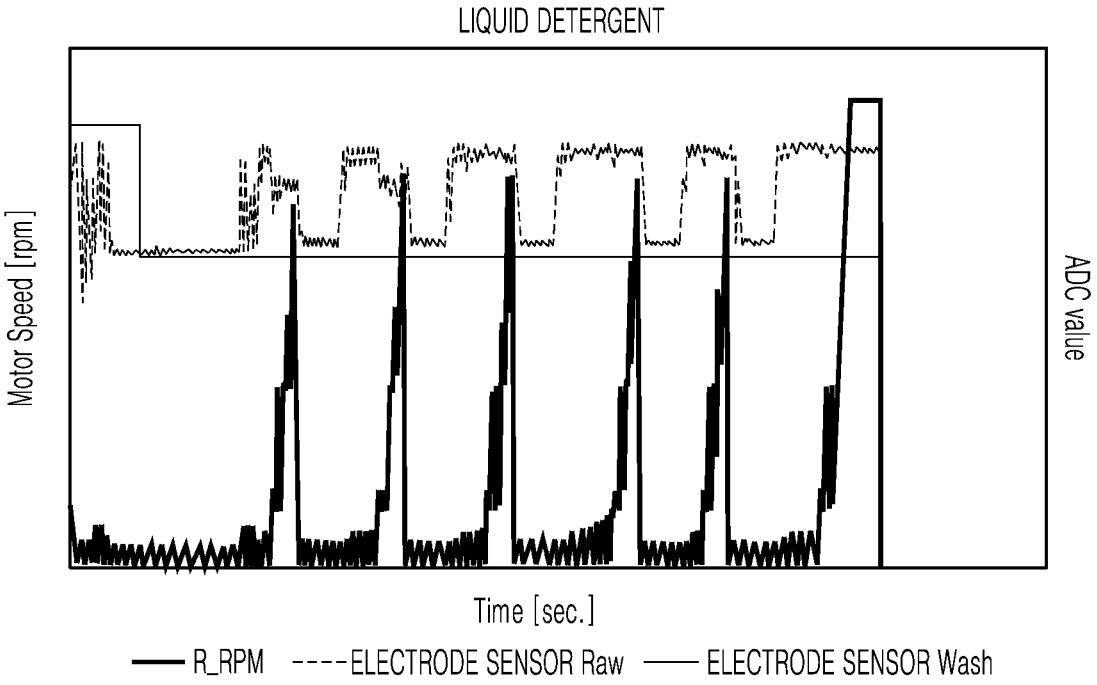

FIG. 7A shows motor movement (R_RPM), detected conductivity (electrode sensor Raw), and corrected conductivity (electrode sensor Wash) during a washing cycle in the case in which liquid detergent is added.

Figure 7B:
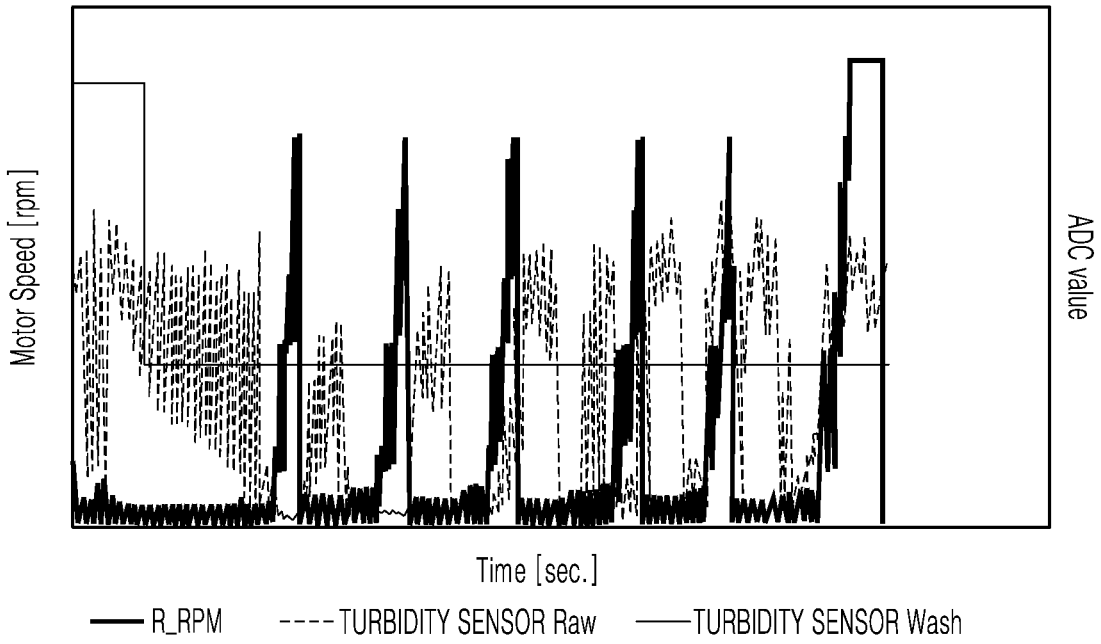

FIG. 7B shows motor movement (R_RPM), detected turbidity (turbidity sensor Raw), and corrected turbidity (turbidity sensor Wash) during a washing cycle in the case in which liquid detergent is added.

In the case of the liquid detergent, as shown in FIGS. 7A and 7B, the corrected conductivity does not change significantly after the start of the washing cycle, but the corrected turbidity changes significantly (in which the ADC value is significantly lowered).

That is, on the basis of changes in the conductivity value and the turbidity value, it is possible to estimate whether the washing water is in a state in which no detergent has been added, in a state in which powder detergent has been added, or in a state in which liquid detergent has been added.

Figure 8:
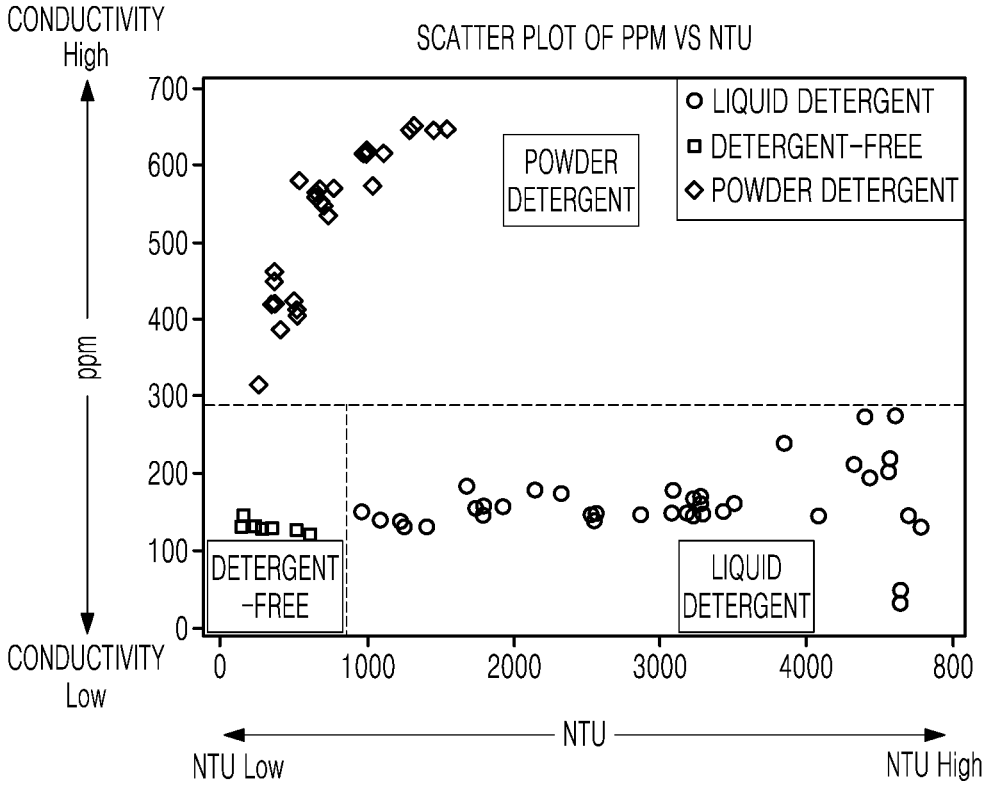
FIG. 8 is a graph illustrating turbidity and conductivity of each detergent type in units of nepthelometric turbidity unit (NTU) and parts per million (ppm)

FIG. 8 is a graph illustrating the turbidity and the conductivity of each detergent type in units of nepthelometric turbidity unit (NTU) and parts per million (ppm).

In the graph of FIG. 8, detergent types are classified on the basis of a decision tree, in which a detergent-free area may be a criterion for determining whether rinsing is completed in the case of performing rinsing.

In the detergent-free case, it can be seen that low turbidity and low conductivity values are generally low. In the case of liquid detergent, it can be seen that the conductivity is relatively low and the turbidity value is relatively high, and in the case of powder detergent, it can be seen that the conductivity is relatively high and the turbidity value is relatively low.

Since the liquid detergent contains a large amount of surfactant components, a large amount of foam is generated during the operation of the washing machine. Accordingly, in the case of the liquid detergent, a relatively high turbidity value is observed compared to the powder detergent.

While it may be ascertained that a certain trend is shown for each type of detergent as described above on the basis of the decision tree as in FIG. 8, if the algorithm is used to classify detergents, there is a high possibility that a misclassification will be made in the boundary area (red line) of classification. In addition, it is difficult to distinguish the amount of detergent by the type of detergent injected in the washing water.

Figure 9:
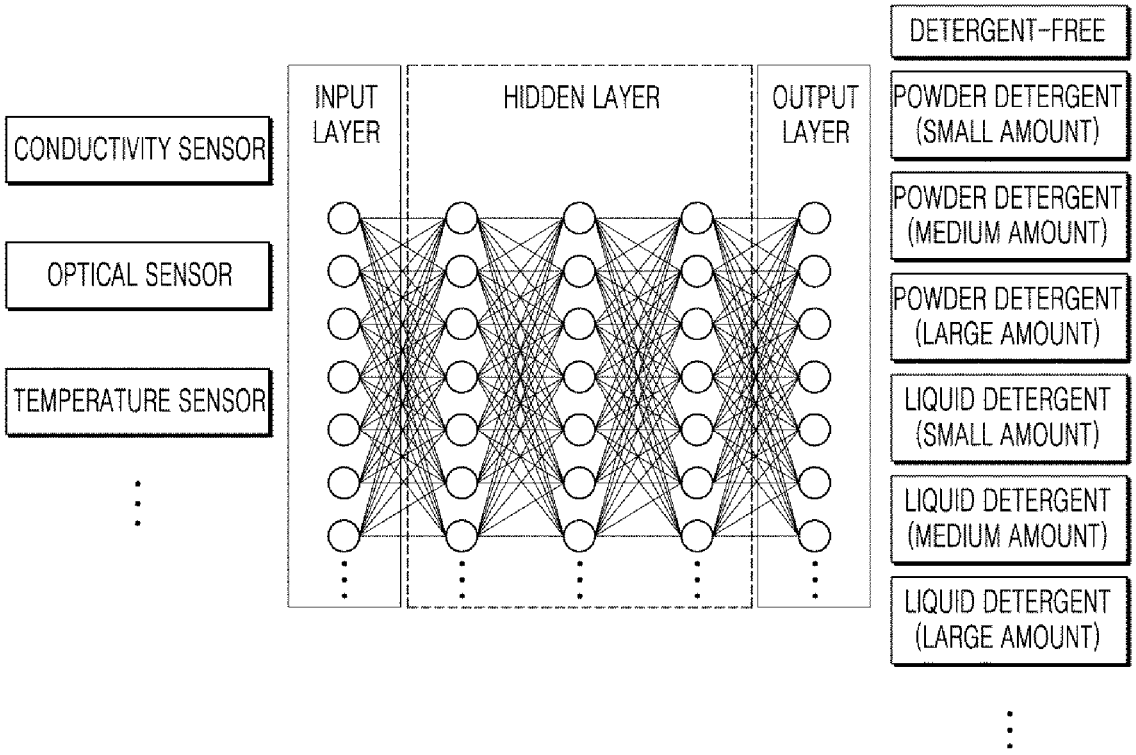
FIG. 9 is a view illustrating a neural network model for estimating the type of laundry and the amount of detergent according to an embodiment of the present disclosure.

FIG. 9 is a view illustrating a neural network model for estimating the type of laundry and the amount of detergent according to an embodiment of the present disclosure.

A deep neural network model of artificial intelligence technology may be used in order to more accurately determine the type and amount of detergent injected in the washing water.

Artificial intelligence (AI) is an area of computer engineering science and information technology that studies methods to make computers mimic intelligent human behaviors such as reasoning, learning, self-improving, and the like.

In addition, the artificial intelligence does not exist on its own, but is rather directly or indirectly related to a number of other fields in computer science. In recent years, there have been numerous attempts to introduce an element of AI into various fields of information technology to solve problems in the respective fields.

Machine learning is an area of artificial intelligence that includes the field of study that gives computers the capability to learn without being explicitly programmed.

Specifically, machine learning is a technology that investigates and builds systems, and algorithms for such systems, which are capable of learning, making predictions, and enhancing their own performance on the basis of experiential data. Machine learning algorithms, rather than only executing rigidly set static program commands, may be used to take an approach that builds models for deriving predictions and decisions from inputted data.

Numerous machine learning algorithms have been developed for data classification in machine learning. Representative examples of such machine learning algorithms for data classification include a decision tree, a Bayesian network, a support vector machine (SVM), an artificial neural network (ANN), and so forth.

Decision tree refers to an analysis method that uses a tree-like graph or model of decision rules to perform classification and prediction.

Bayesian network may include a model that represents the probabilistic relationship (conditional independence) among a set of variables. Bayesian network may be appropriate for data mining via unsupervised learning.

SVM may include a supervised learning model for pattern detection and data analysis, heavily used in classification and regression analysis.

ANN is a data processing system modelled after the mechanism of biological neurons and interneuron connections, in which a number of neurons, referred to as nodes or processing elements, are interconnected in layers.

ANNs are models used in machine learning and may include statistical learning algorithms conceived from biological neural networks (particularly of the brain in the central nervous system of an animal) in machine learning and cognitive science.

ANNs may refer generally to models that have artificial neurons (nodes) forming a network through synaptic interconnections, and acquires problem-solving capability as the strengths of synaptic interconnections are adjusted throughout training.

The terms "artificial neural network" and "neural network" may be used interchangeably herein.

An ANN may include a number of layers, each including a number of neurons. In addition, the Artificial Neural Network can include the synapse for connecting between neuron and neuron.

An ANN may be defined by the following three factors: (1) a connection pattern between neurons on different layers; (2) a learning process that updates synaptic weights; and (3) an activation function generating an output value from a weighted sum of inputs received from a lower layer.

ANNs include, but are not limited to, network models such as a deep neural network (DNN), a recurrent neural network (RNN), a bidirectional recurrent deep neural network (BRDNN), a multilayer perception (MLP), and a convolutional neural network (CNN).

An ANN may be classified as a single-layer neural network or a multi-layer neural network, based on the number of layers therein.

A general a single-layer neural network is composed of an input layer and an output layer.

Further, in general, a multi-layer neural network may include an input layer, one or more hidden layers, and an output layer.

The input layer receives data from an external source, and the number of neurons in the input layer is identical to the number of input variables. The hidden layer is located between the input layer and the output layer, and receives signals from the input layer, extracts features, and feeds the extracted features to the output layer. The output layer receives a signal from the hidden layer and outputs an output value based on the received signal. Input signals between the neurons are summed together after being multiplied by corresponding connection strengths (synaptic weights), and if this sum exceeds a threshold value of a corresponding neuron, the neuron can be activated and output an output value obtained through an activation function.

A deep neural network with a plurality of hidden layers between the input layer and the output layer may be the most representative type of artificial neural network which enables deep learning, which is one machine learning technique.

An ANN can be trained using training data. Here, the training may refer to the process of determining parameters of the artificial neural network by using the training data, to perform tasks such as classification, regression analysis, and clustering of inputted data. Such parameters of the artificial neural network may include synaptic weights and biases applied to neurons.

An ANN trained using training data can classify or cluster inputted data according to a pattern within the inputted data.

Throughout the present specification, an artificial neural network trained using training data may be referred to as a trained model.

Hereinbelow, learning paradigms of an artificial neural network will be described in detail.

Learning paradigms, in which an artificial neural network operates, may be classified into supervised learning, unsupervised learning, semi-supervised learning, and reinforcement learning.

Supervised learning is a machine learning method that derives a single function from the training data.

Among the functions that may be thus derived, a function that outputs a continuous range of values may be referred to as a regressor, and a function that predicts and outputs the class of an input vector may be referred to as a classifier.

In supervised learning, an artificial neural network can be trained with training data that has been given a label.

Here, the label may refer to a target answer (or a result value) to be guessed by the artificial neural network when the training data is input to the artificial neural network.

Throughout the present specification, the target answer (or a result value) to be guessed by the artificial neural network when the training data is input may be referred to as a label or labeling data.

Throughout the present specification, assigning one or more labels to training data in order to train an artificial neural network may be referred to as labeling the training data with labeling data.

Training data and labels corresponding to the training data together may form a single training set, and as such, they may be input to an artificial neural network as a training set.

The training data may exhibit a number of features, and the training data being labeled with the labels may be interpreted as the features exhibited by the training data being labeled with the labels. In this case, the training data may represent a feature of an input object as a vector.

Using training data and labeling data together, the artificial neural network may derive a correlation function between the training data and the labeling data. Then, through evaluation of the function derived from the artificial neural network, a parameter of the artificial neural network may be determined (optimized).

Unsupervised learning is a machine learning method that learns from training data that has not been given a label.

More specifically, unsupervised learning may be a training scheme that trains an artificial neural network to discover a pattern within given training data and perform classification by using the discovered pattern, rather than by using a correlation between given training data and labels corresponding to the given training data.

Examples of unsupervised learning include, but are not limited to, clustering and independent component analysis.

Examples of artificial neural networks using unsupervised learning include, but are not limited to, a generative adversarial network (GAN) and an autoencoder (AE).

GAN is a machine learning method in which two different artificial intelligences, a generator and a discriminator, improve performance through competing with each other.

The generator may be a model generating new data that generates new data based on true data.

The discriminator may be a model recognizing patterns in data that determines whether input data is from the true data or from the new data generated by the generator.

Furthermore, the generator may receive and learn from data that has failed to fool the discriminator, while the discriminator may receive and learn from data that has succeeded in fooling the discriminator. Accordingly, the generator may evolve so as to fool the discriminator as effectively as possible, while the discriminator evolves so as to distinguish, as effectively as possible, between the true data and the data generated by the generator.

An autoencoder (AE) is a neural network which aims to reconstruct its input as output.

More specifically, an AE may include an input layer, at least one hidden layer, and an output layer.

Since the number of nodes in the hidden layer is smaller than the number of nodes in the input layer, the dimensionality of data is reduced, thus leading to data compression or encoding.

Furthermore, the data outputted from the hidden layer may be input to the output layer. Given that the number of nodes in the output layer is greater than the number of nodes in the hidden layer, the dimensionality of the data increases, thus leading to data decompression or decoding.

Furthermore, in the AE, the input data is represented as hidden layer data as interneuron connection strengths are adjusted through training. The fact that when representing information, the hidden layer is able to reconstruct the input data as output by using fewer neurons than the input layer may indicate that the hidden layer has discovered a hidden pattern in the input data and is using the discovered hidden pattern to represent the information.

Semi-supervised learning is machine learning method that makes use of both labeled training data and unlabeled training data.

One semi-supervised learning technique involves inferring the label of unlabeled training data, and then using this inferring label for learning. This technique may be used advantageously when the cost associated with the labeling process is high.

Reinforcement learning may be based on a theory that given the condition under which a reinforcement learning agent can determine what action to choose at each time instance, the agent can find an optimal path to a solution solely based on experience without reference to data.

Reinforcement learning may be performed mainly through a Markov decision process (MDP).

Markov decision process consists of four stages: first, an agent is given a condition containing information required for performing a next action; second, how the agent behaves in the condition is defined; third, which actions the agent should choose to get rewards and which actions to choose to get penalties are defined; and fourth, the agent iterates until future reward is maximized, thereby deriving an optimal policy.

An artificial neural network is characterized by features of its model, the features including an activation function, a loss function or cost function, a learning algorithm, an optimization algorithm, and so forth. Also, the hyperparameters are set before learning, and model parameters can be set through learning to specify the architecture of the artificial neural network.

For instance, the structure of an artificial neural network may be determined by a number of factors, including the number of hidden layers, the number of hidden nodes included in each hidden layer, input feature vectors, target feature vectors, and so forth.

Hyperparameters may include various parameters which need to be initially set for learning, much like the initial values of model parameters. Also, the model parameters may include various parameters sought to be determined through learning.

For instance, the hyperparameters may include initial values of weights and biases between nodes, mini-batch size, iteration number, learning rate, and so forth. Furthermore, the model parameters may include a weight between nodes, a bias between nodes, and so forth.

Loss function may be used as an index (reference) in determining an optimal model parameter during the learning process of an artificial neural network. Learning in the artificial neural network involves a process of adjusting model parameters so as to reduce the loss function, and the purpose of learning may be to determine the model parameters that minimize the loss function.

Loss functions typically use means squared error (MSE) or cross entropy error (CEE), but the present disclosure is not limited thereto.

Cross-entropy error may be used when a true label is one-hot encoded. One-hot encoding may include an encoding method in which among given neurons, only those corresponding to a target answer are given 1 as a true label value, while those neurons that do not correspond to the target answer are given 0 as a true label value.

In machine learning or deep learning, learning optimization algorithms may be deployed to minimize a cost function, and examples of such learning optimization algorithms include gradient descent (GD), stochastic gradient descent (SGD), momentum, Nesterov accelerate gradient (NAG), Adagrad, AdaDelta, RMSProp, Adam, and Nadam.

GD includes a method that adjusts model parameters in a direction that decreases the output of a cost function by using a current slope of the cost function.

The direction in which the model parameters are to be adjusted may be referred to as a step direction, and a size by which the model parameters are to be adjusted may be referred to as a step size.

Here, the step size may mean a learning rate.

GD obtains a slope of the cost function through use of partial differential equations, using each of model parameters, and updates the model parameters by adjusting the model parameters by a learning rate in the direction of the slope.

SGD may include a method that separates the training dataset into mini batches, and by performing gradient descent for each of these mini batches, increases the frequency of gradient descent.

Adagrad, AdaDelta and RMSProp may include methods that increase optimization accuracy in SGD by adjusting the step size, and may also include methods that increase optimization accuracy in SGD by adjusting the momentum and step direction. Adam may include a method that combines momentum and RMSProp and increases optimization accuracy in SGD by adjusting the step size and step direction. Nadam may include a method that combines NAG and RMSProp and increases optimization accuracy by adjusting the step size and step direction.

Learning rate and accuracy of an artificial neural network rely not only on the structure and learning optimization algorithms of the artificial neural network but also on the hyperparameters thereof. Therefore, in order to obtain a good learning model, it is important to choose a proper structure and learning algorithms for the artificial neural network, but also to choose proper hyperparameters.

In general, the artificial neural network is first trained by experimentally setting hyperparameters to various values, and based on the results of training, the hyperparameters can be set to optimal values that provide a stable learning rate and accuracy.

When a determination is made on the basis of the decision tree as described above with reference to FIG. 8, there is a high possibility that the conditions located at the boundary of the detergent-free, powder detergent, and liquid detergent areas will be misclassified. However, in the deep learning algorithm as in FIG. 9, by allowing each sensor value and a pattern in which the sensor value changes to be learned, it is possible to estimate the type and amount of detergent injected in the washing water more accurately.

While there may be various methods for generating a deep neural network model for use in an embodiment of the present disclosure, in the case of supervised learning, the following training process may be performed as a preliminary work.

In order to create a neural network model capable of estimating the type and amount of detergent injected in to the washing water, a washing machine manufacturer or learning model creator injects various types and amounts of detergent into the washing water and records the conductivity and turbidity data measured while the washing machine is operating. In addition, each piece of recorded data is labeled with the type and amount of detergent injected for the corresponding condition. Through this, training data including the conductivity and turbidity measured in the washing water and the type and amount of detergent injected in the washing water may be prepared as labels.

The neural network model may be trained on the basis of the training data prepared as above, and as a result of the training, a deep neural network model capable of estimating the type and amount of detergent injected in the washing water may be obtained based on the conductivity and turbidity of the washing water.

Meanwhile, the data used in the training step may further include temperature data, and the neural network model trained on the basis of the data may estimate the type and amount of detergent injected in the washing water based on the conductivity, turbidity, and temperature of the washing water.

In addition, other types of data regarding the physical properties of the washing water may be added, and accordingly, a model for detecting the type and amount of detergent injected in the washing water may be created by receiving the physical properties of the washing water detected using various sensors.

As another example, the neural network model may be trained using a signal pattern for conductivity and turbidity measured for each of the detergent-free case, the case of powder detergent, and the case of liquid detergent shown in FIGS. 5 to 7 as training data.

As described above, when the type and amount of detergent injected in the washing water are accurately determined through the neural network model trained in advance, the washing machine processor may adjust the operation of the washing machine more appropriately based on the determined situation.

Figure 10:
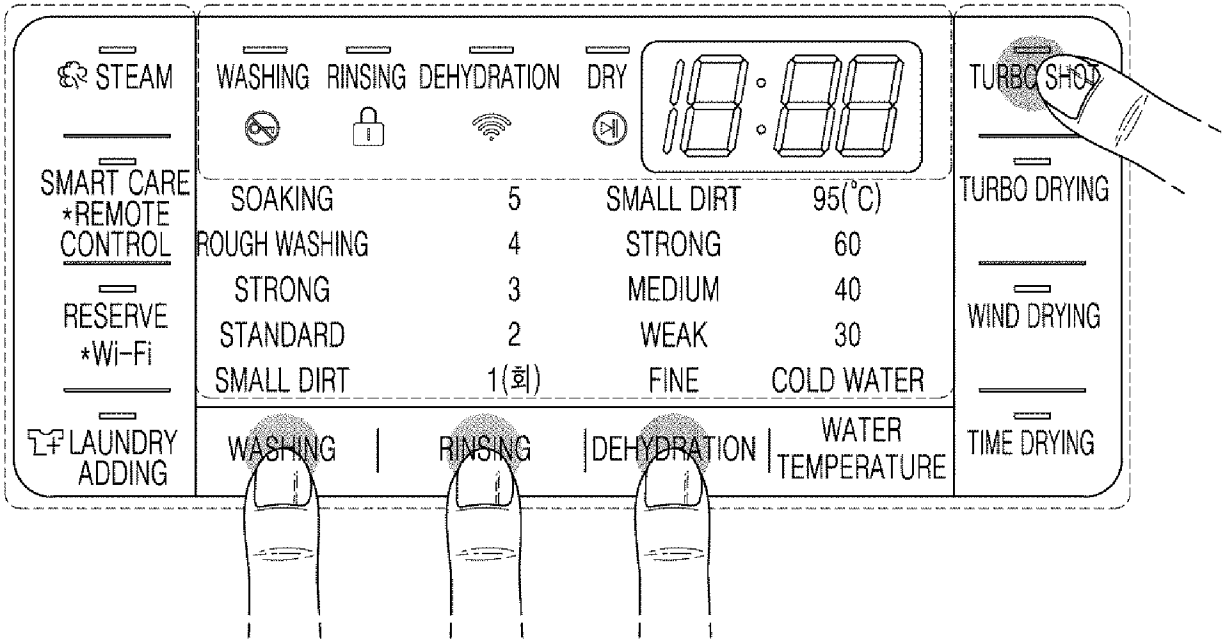
FIG. 10 is a view illustrating operation of a washing machine according to an embodiment of the present disclosure.

FIG. 10 is a view illustrating a control panel of a washing machine for explaining the overall operation of the washing machine according to an embodiment of the present disclosure.

A user may manually determine which cycle is to be performed and under what conditions the washing is to be performed by pushing one of washing, rinsing, and dehydration cycle buttons in the control panel 114 of the washing machine 100. However, most users do not know the proper cycle conditions in the environment in which they perform washing.

Therefore, in general, the washing machine 100 has a preset washing operation algorithm, and when a washing start button is pushed after laundry is loaded and specific conditions are selected, the washing machine processor detects the amount of laundry, and plans water supply amount, washing time, washing motion, rinsing time, rinsing method, dehydration cycle time, and dehydration cycle method based on the detected amount of laundry and the inputted specific conditions.

The operation of the washing machine 100 may be generally divided into a washing cycle, a rinsing cycle, and a dehydration cycle, and how much time is allocated to each time, how water supply and drainage are performed at each step, and how to adjust the rotation speed of the drum are determined based on, for example, the amount of laundry, the washing target set by the user, and the type and amount of injected laundry detergent.

Once the operation plan of the washing machine is determined, the control panel 114 may display detailed washing conditions (such as total washing machine operation time, soaking frequency, rough-washing frequency, washing intensity, and rinsing frequency) according to the plan, and the user may thus be informed of the operation plan of the washing machine.

Figure 11:
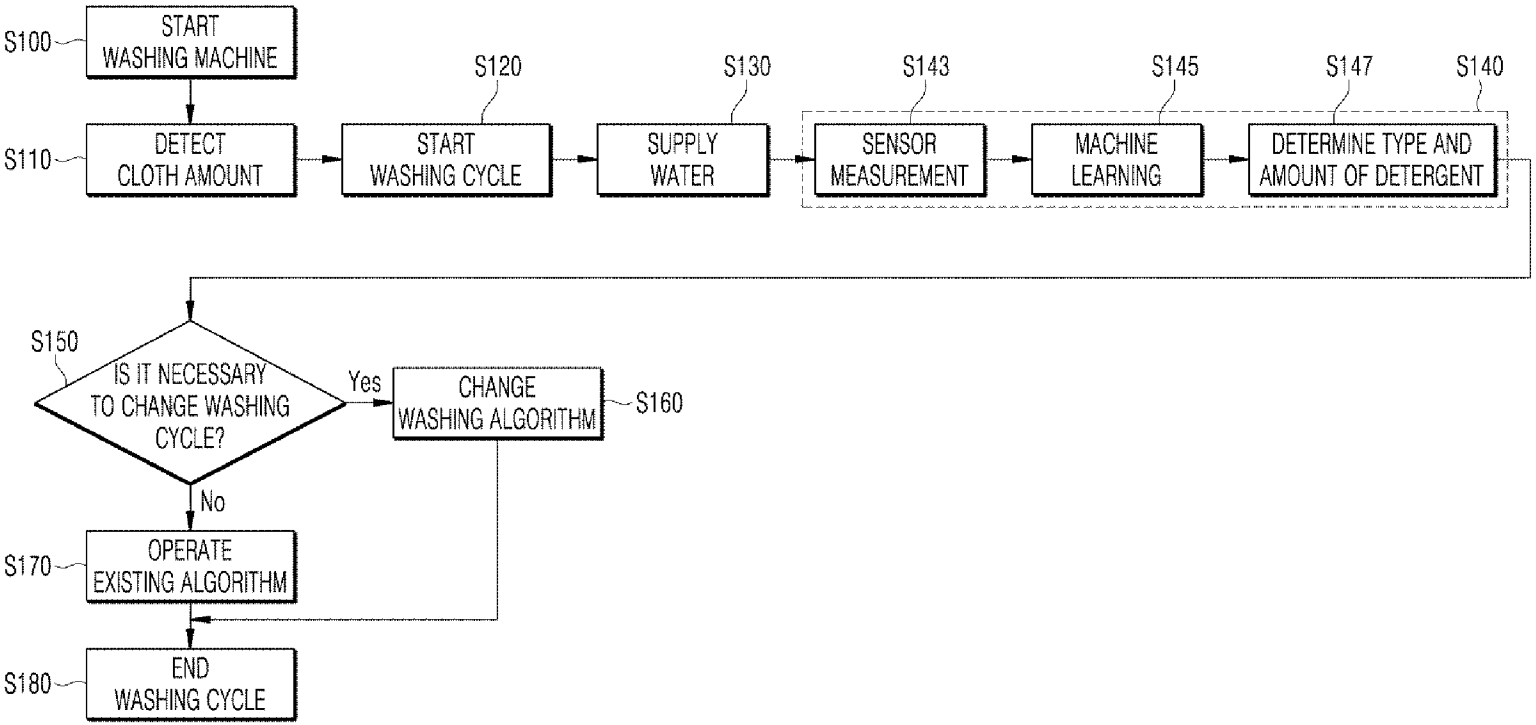
FIG. 11 is a view illustrating a washing cycle of a washing machine according to an embodiment of the present disclosure.

FIG. 11 is a view illustrating the washing cycle of a washing machine according to an embodiment of the present disclosure.

The user may open the door 103 of the washing machine 100, may load laundry into the first tub 120, and may then add detergent. Then, the user may select desired washing intensity using the control panel 114, and may push the washing start button (S100).

The washing machine 100 may detect the amount of laundry loaded into the first tub 120 (laundry amount) using a weight sensor while driving the first tub 120 by a small amount (S110). Based on the detected amount of laundry and the washing option selected by the user, the washing machine processor may determine and start the washing cycle (S120). The washing cycle determined here may be a plan of the overall washing operation, or may be only a part of the washing cycle temporarily determined before detecting the amount and type of detergent injected in the washing water.

Based on the determined washing cycle, the washing machine 100 may supply water through the water supply pipe 113, and washing water and detergent may be mixed in the detergent drawer 115 and supplied into the second tub 140 (S130). The washing water supplied to the second tub 140 may be supplied into the first tub 120 through the openings in the surface of the first tub 120.

In the case of a top load washing machine rather than a drum washing machine, washing water may be directly supplied into an inner tub into which laundry is loaded, and the washing water may be supplied to an outer tub through the openings in the inner tub.

Here, it should be noted that "supplying washing water to the first tub 120 by a water supplier 110" includes not only "directly supplying the washing water to the first tub 120," but also "supplying the washing water to the first tub 120 through the second tub 140."

After the washing water is supplied, the type and amount of detergent injected in the washing water may be estimated according to the detection of the detergent detection sensor 130 (S140). The detergent detection sensor 130 may first measure the first conductivity and first turbidity of the washing water (S143). The measured first conductivity and first turbidity may be inputted to a neural network model, which is a kind of machine learning described above (S145). The neural network model, which receives the first conductivity and first turbidity as input values, may determine the type and amount of detergent injected in the washing water (S147).

Here, the detergent detection sensor 130 may additionally detect a first temperature of the wash water, and may correct the first conductivity and first turbidity inputted to the neural network model based on the first temperature, and the neural network model may estimate the type and amount of detergent based on the first conductivity and first turbidity corrected based on the detected first temperature.

Here, when the estimated amount of detergent is less than a predetermined threshold, the washing machine processor may generate a signal requesting additional injection of detergent, and may transmit the request signal to the user through the display or the communication device of the washing machine 100.

Here, the predetermined threshold may be the amount of detergent for each type of detergent required for each weight section of the laundry, and the threshold may be changed on the basis of the amount of laundry detected by the weight sensor.

For example, if the weight of laundry is 8 kg and the amount of powder detergent estimated using the neural network model is 20 g, the washing machine processor may notify the user that 50 g of detergent should be additionally injected on the basis of a table for the suitable amount of detergent for each weight section of laundry.

If it is determined that no detergent has been injected, the washing machine processor may notify the user through the display or the communication device that no detergent has been injected, and if there is no feedback from the user, the washing machine processor may operate the washing machine while shortening the time of the washing cycle.

The washing machine processor may determine whether the washing cycle needs to be changed based on the estimated type and amount of detergent (S150). If the previously determined washing cycle does not need to be changed, washing is performed according to the existing algorithm (S170), and if it is determined that a change is required in the washing cycle, the washing machine processor may change the washing algorithm (S160).

The washing machine processor may change the washing algorithm and the washing cycle such that washing can be efficiently performed to suit the type and amount of detergent estimated from the previously determined plan.

Meanwhile, the washing machine processor may determine the washing cycle to be changed by further considering the amount of laundry in addition to the type and amount of detergent injected in the wash water.

Meanwhile, according to the flowchart of FIG. 11, the washing cycle is initially determined after the detection of the cloth amount, and the determined washing cycle is changed based on the detected type and amount of detergent. However, the washing machine processor may perform water supply and the driving of the washing machine without specifically determining the washing cycle after detecting the cloth amount, and the washing machine processor may determine the washing cycle on the basis of the detected value for the first time after detecting the physical properties of the washing water (conductivity, turbidity, and temperature).

Meanwhile, the state of the washing water may be additionally detected before the washing cycle ends, and the washing cycle may be additionally changed based on the detected conductivity, turbidity, and temperature. When all the washing is performed according to the determined washing cycle, the washing cycle ends (S180).

Figure 12:
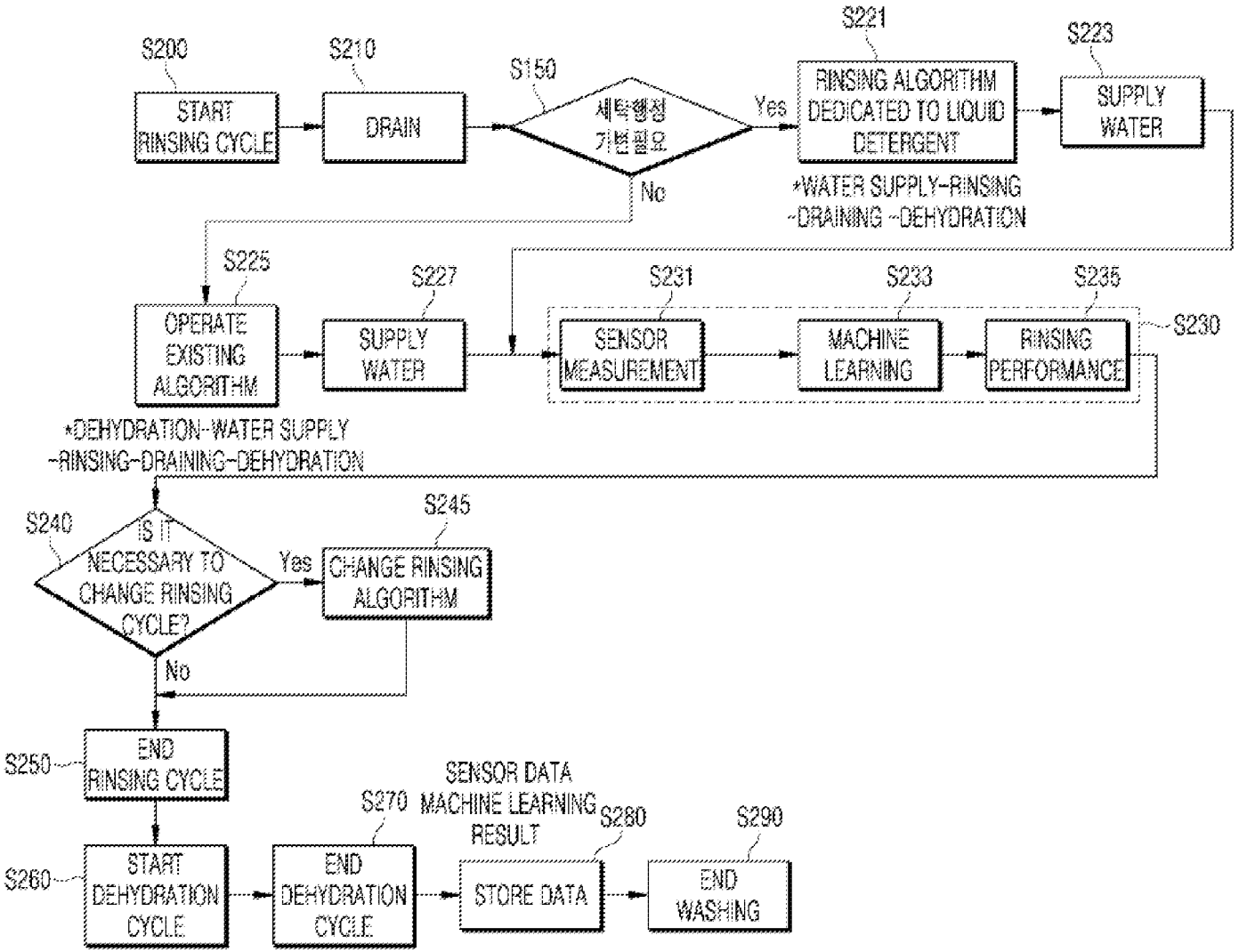
FIG. 12 is a view illustrating a rinsing cycle and dehydration cycle of a washing machine according to an embodiment of the present disclosure.

FIG. 12 is a view illustrating the rinsing cycle and dehydration cycle of a washing machine according to an embodiment of the present disclosure.

After all the washing cycle has ended, the rinsing cycle may start (S200). For the rinsing cycle, the washing water in which detergent and contaminants are dissolved should first be drained (S210). After draining, different rinsing algorithms may be applied based on what type of detergent was determined during the washing cycle (S220).

In the case of liquid detergent, a rinsing algorithm dedicated to liquid detergent may have to be applied (S221), which may be a process of proceeding with water supply, rinsing, draining, and dehydration. In the case of powder detergent, the washing machine may be operated by the existing rinsing algorithm (S225), which may be a process of proceeding with dehydration, water supply, rinsing, draining, and dehydration.

In the process of performing rinsing according to the rinsing algorithm, the detergent detection sensor 130 may measure the physical properties of the rinsing water (S230). The detergent detection sensor 130 may detect a second conductivity and a second turbidity of the rinsing water (S231), and the detected second conductivity and second turbidity may be inputted to the neural network model, which is a kind of machine learning described above (S233).

Here, the neural network model may be a deep neural network model trained to estimate the type and amount of detergent injected in the washing water based on the conductivity and turbidity of the rinsing water. The deep neural network model may estimate the amount of detergent in the rinsing water during the rinsing cycle. The washing machine processor may determine a required rinsing frequency and rinsing motion based on the estimated amount of detergent, and may change the rinsing cycle accordingly.

Meanwhile, the second conductivity and second turbidity inputted to the deep neural network model may have values that are corrected based on temperature for standardized values.

The washing machine processor may estimate the amount of detergent in the rinsing water by measuring the second conductivity and the second turbidity in the initial rinsing process through the detergent detection sensor 130, and, after the rinsing cycle is performed for a predetermined period of time, the washing machine processor may estimate the amount of detergent remaining in the rinsing water by measuring a third conductivity and a third turbidity through the detergent detection sensor 130.

According to the above-described operation, the washing machine processor may determine the amount of detergent reduced while the rinsing cycle is performed for a predetermined period of time, and may estimate the rinsing performance of the washing machine (S235).

Alternatively, the washing machine processor may measure the second conductivity and the second turbidity in the initial rinsing process through the detergent detection sensor 130, and after the rinsing cycle is performed for a predetermined period of time, the washing machine processor may measure the third conductivity and the third turbidity through the detergent detection sensor 130, and the washing machine may determine the rinsing performance of the washing machine on the basis of the difference between the second conductivity and the third conductivity and the difference between the second turbidity and the third turbidity.

The washing machine processor may determine whether all the detergent has been removed and thus whether the rinsing cycle can actually be adequately performed after the rinsing cycle is completed in consideration of the estimated rinsing performance of the washing machine and the remaining rinsing operation in the originally planned rinsing cycle. On this basis, the washing machine processor may determine whether a change is necessary in the rinsing cycle (S240).

If it is determined that the remaining detergent can be sufficiently removed according to the existing rinsing cycle, the washing machine processor may finish the rinsing cycle after the rinsing cycle is performed as it is, and if it is determined that the remaining detergent cannot be sufficiently removed by the existing rinsing cycle, the washing machine processor may change the rinsing algorithm (S245).

Based on the estimated rinsing performance, the washing machine processor may determine an estimated degree of rinsing after the rinsing cycle is completed, and may transmit information on the estimated degree of rinsing to the user terminal via the communication device.

In consideration of the estimated degree of rinsing, the user may transmit, to the washing machine, a feedback signal as to whether to perform the rinsing cycle for longer or whether to perform the rinsing cycle as planned, using the user terminal.

The washing machine processor may correct the rinsing cycle or maintain the existing rinsing cycle in response to the feedback signal received from the user terminal.

When the rinsing algorithm is changed and all the rinsing is performed accordingly, the rinsing cycle may end (S250). Meanwhile, an operation of additionally determining whether to complete the rinsing by again performing the detection of the amount of detergent on the rinsing water before completing the rinsing cycle may be added.

After the rinsing cycle is completed, the dehydration cycle may start (S260). The dehydration cycle may also be determined on the basis of at least one of the washing cycle, the rinsing cycle, which have been previously performed, or the type and amount of detergent, which have been detected during these processes.

After the dehydration cycle is completed (S270), sensor data detected during the whole washing machine operation, information on the type and amount of detergent estimated by the deep neural network, and information on the operation of the washing machine performed in the washing cycle, the rinsing cycle, and the dehydration cycle may be stored in memory as washing data (S280).

The stored washing data may then be used as a reference for determining the washing cycle, rinsing cycle, and dehydration cycle when the washing machine is operated again, and may be transmitted to an external server so that the stored washing data can be used as a reference for determining the washing cycle, rinsing cycle, and dehydration cycle by other washing machines.

In addition, when a value recorded in the washing data is out of a normal range, the external server may determine that there is an abnormality in the washing machine, and may transmit an alarm to the user indicating that inspection is required.

Meanwhile, the washing machine 100 may accumulate operation information of the washing machine operated while performing the washing cycle, rinsing cycle, and dehydration cycle in a memory or an external server, and, on the basis of the accumulated operation information, the washing machine 100 may determine whether more or less detergent than a suitable amount is being injected, and whether the type of detergent is suitable.

Here, the operation information of the washing machine may include one or more of the operation time of the washing machine in each cycle, the amount and type detergent injected the wash water, or the amount of laundry.

This determination may be performed by the washing machine processor, or may be transmitted to the washing machine 100 after being performed in the external server. According to this determination, the washing machine processor may output a suggestion related to at least one of the amount or the type of detergent type to the user.

Such a suggestion may prevent the type and amount of detergent from being determined according to the user's habit, and may guide the user to select the type and amount of detergent suitable for the user's actual washing amount.

In addition, the washing machine processor may also make a suggestion as to the amount of laundry, and may guide the user by warning that too much laundry has been loaded, so that washing can be effectively performed.

Figure 13:
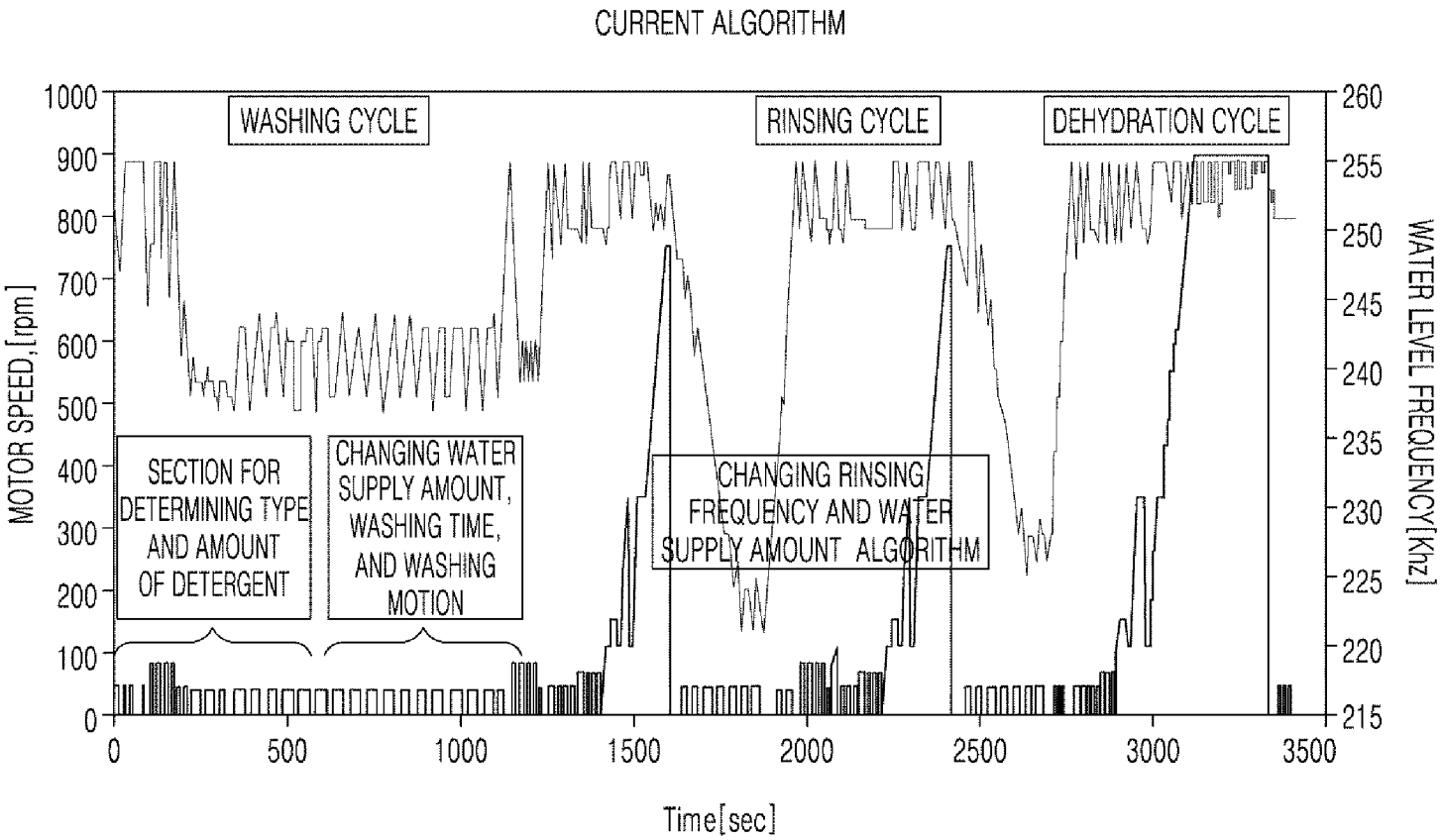
FIG. 13 is a view illustrating a motor speed and a water level frequency that change during the operation of a washing machine according to an embodiment of the present disclosure.

FIG. 13 is a view illustrating a motor speed and a water level frequency that change during the operation of a washing machine according to an embodiment of the present disclosure.

In FIG. 13, the motor speed expressed in rpm is represented by a thick line, and the water level frequency expressed in kHz is represented by a thin line.

During the washing cycle, the motor speed is adjusted between 50 and 100 rpm and the water level frequency is adjusted between 500 and 900 kHz. The higher the rpm, the faster the motor speed, the higher the kHz value of the water level frequency, the lower the water level, and the lower the kHz value, the higher the water level.

During the washing cycle, the type and amount of detergent are determined, and the amount of washing water, washing time, and washing motion may change on the basis of the determined type and amount of detergent. After the washing cycle is finished, dehydration is briefly performed, and during the rinsing cycle, the rinsing frequency, the amount of rinsing water, and the rinsing algorithm may be changed based on the amount of detergent detected in the rinsing water.

Figure 14:
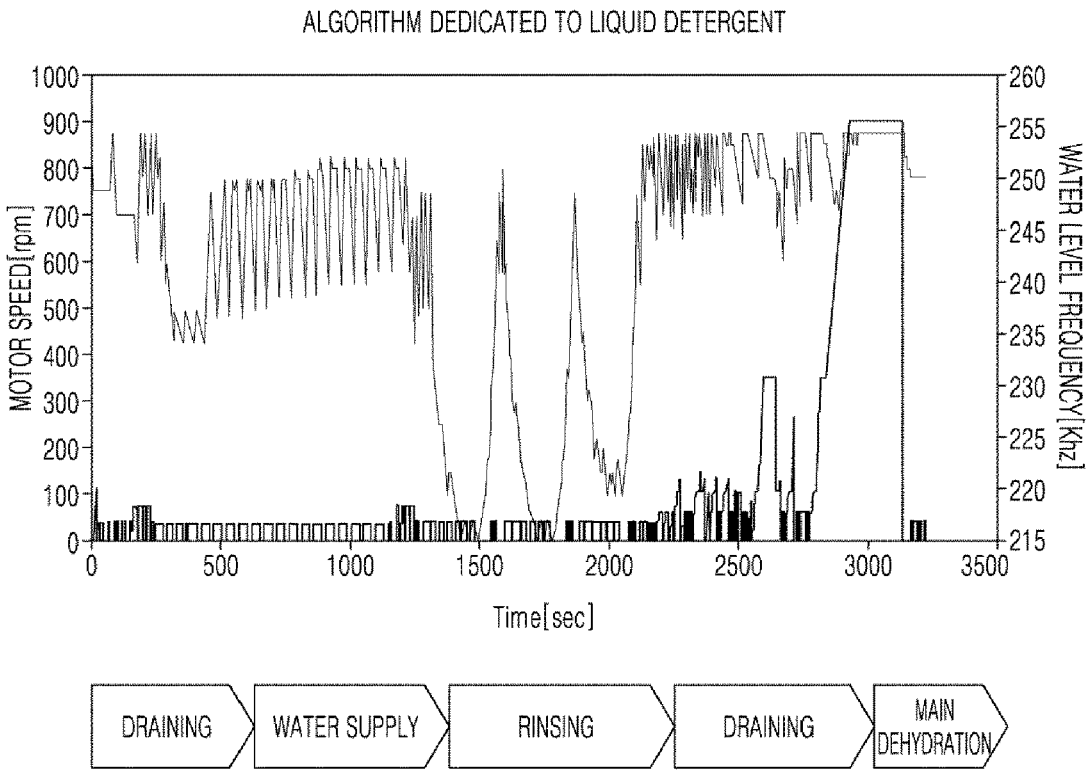
FIG. 14 is a view illustrating a motor speed and a water level frequency that change during operation when liquid detergent is injected into a washing machine according to an embodiment of the present disclosure.

FIG. 14 is a view illustrating a motor speed and a water level frequency that change during operation when liquid detergent is injected into a washing machine according to an embodiment of the present disclosure.

In view of the motor speed in FIG. 14, it can be seen that, in the case of liquid detergent, a brief dehydration process was omitted after the washing cycle was completed. In addition, in the case of liquid detergent, the rinsing frequency, the amount of rinsing water, and the motor speed may vary.

A liquid detergent contains many surfactants, so a large amount of foam is generated during the operation of the washing machine. The foam generated thereby is not easily removed, and may be a factor causing an increase in the operation time of the washing machine.

When the type of detergent is erroneously determined and thus a washing machine operation that is not suitable for the type of detergent is performed, the washing time may be increased and the washing efficiency may also be reduced. In general, washing machine manufacturers develop algorithms according to testing methods executed by performance evaluation agencies, and standard laboratories test perform the testing methods using powder detergent. Therefore, general washing machines operate with a single algorithm without considering the case in which liquid detergent is used.

In the washing machine according to an embodiment of the present disclosure, by detecting turbidity in addition to conductivity in washing water and rinsing water, which makes it possible to accurately determine the type of detergent at the beginning of washing, and thus to accurately determine the amount of detergent, the most efficient washing operation can be performed.

In addition, in the washing machine according to the embodiment of the present disclosure, when a large amount of foam is generated due to the injected liquid detergent, a rinsing algorithm dedicated to liquid detergent is operated to ensure that effective rinsing is performed.

Figure 15:
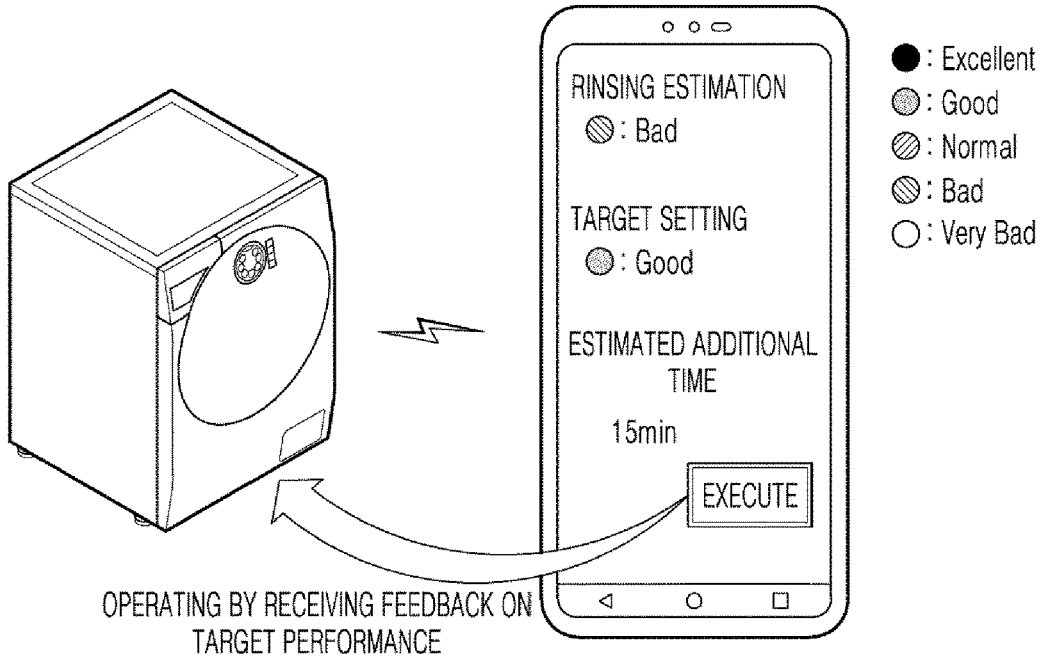
FIG. 15 is a view illustrating processes of transmitting estimated rinsing information to a user terminal and receiving user feedback during the rinsing cycle of a washing machine according to an embodiment of the present disclosure.

FIG. 15 is a view illustrating processes of transmitting estimated rinsing information to a user terminal and receiving user feedback during the rinsing cycle of a washing machine according to an embodiment of the present disclosure.

As illustrated in the example of FIG. 15, the washing machine processor may estimate the degree of rinsing as "Bad" for the existing rinsing cycle in step S235 of anticipating the rinsing performance, and may calculate an additional time required in order to make the degree of rinsing become "Good" as 15 minutes.

The washing machine processor may transmit the above information to the user terminal through the communication device, and may request the user's confirmation as to whether to add the rinsing time of 15 minutes to the rinsing cycle.

When the user confirms "Good" as the target rinsing performance, the washing machine may adjust the rinsing cycle on the basis this feedback.

This feedback process may be performed not only in adjusting the rinsing cycle, but also in adjusting the washing cycle. The feedback process may also be performed in the suggestion of adjusting the type and amount of detergent.

The user may further refine the learning model for adjusting the washing cycle by continuously providing feedback regarding the determination result of the deep neural network model.

Figure 16A:
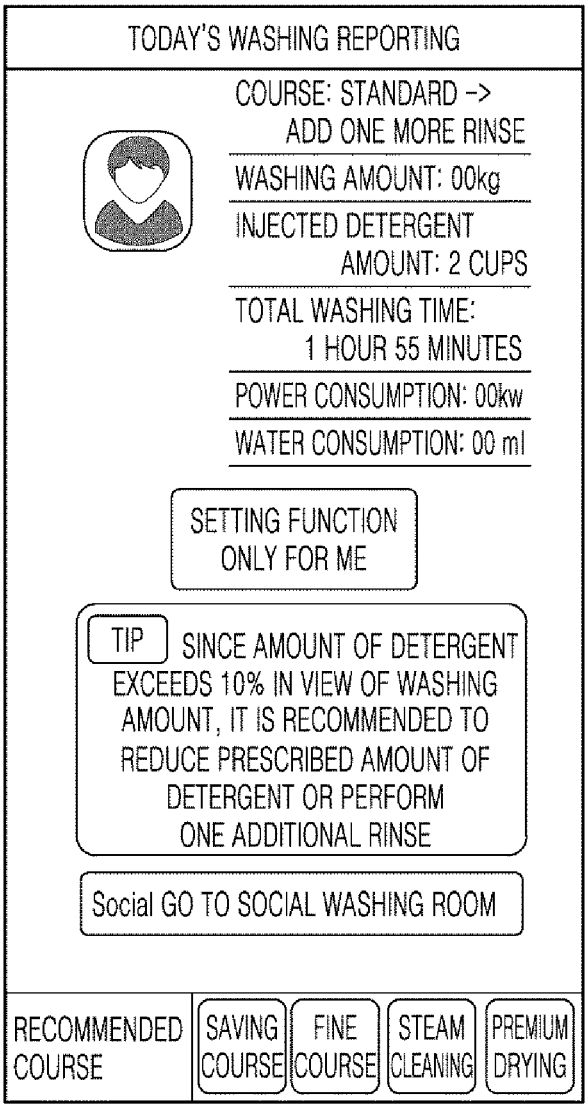
FIG. 16A to 16C are views each illustrating an example of a washing reporting screen delivered to a user after the operation of the washing machine is completed according to an embodiment of the present disclosure.
Figure 16B:
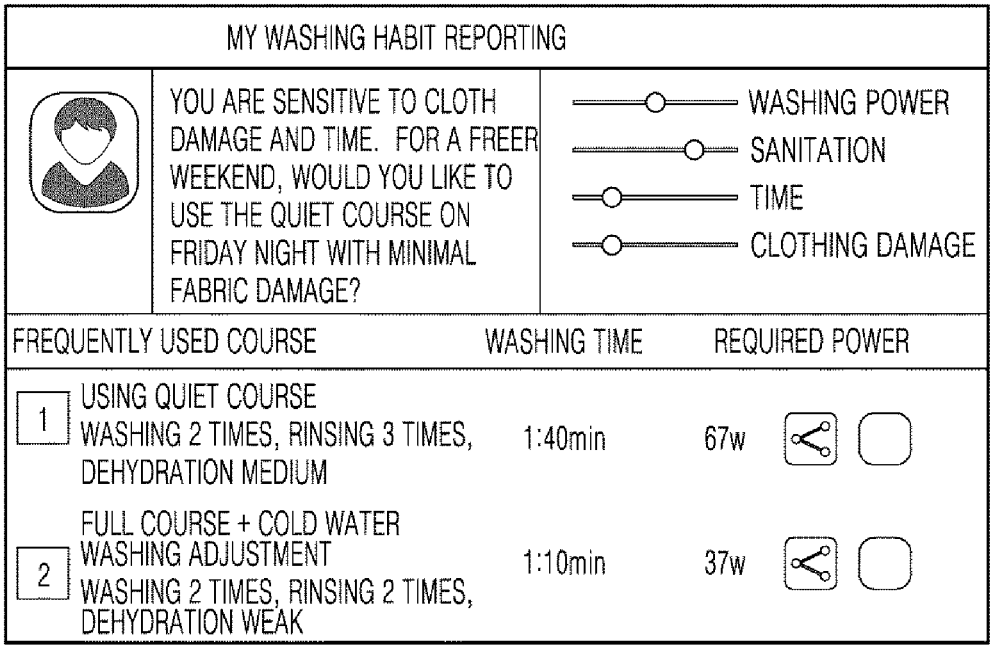
Figure 16C:
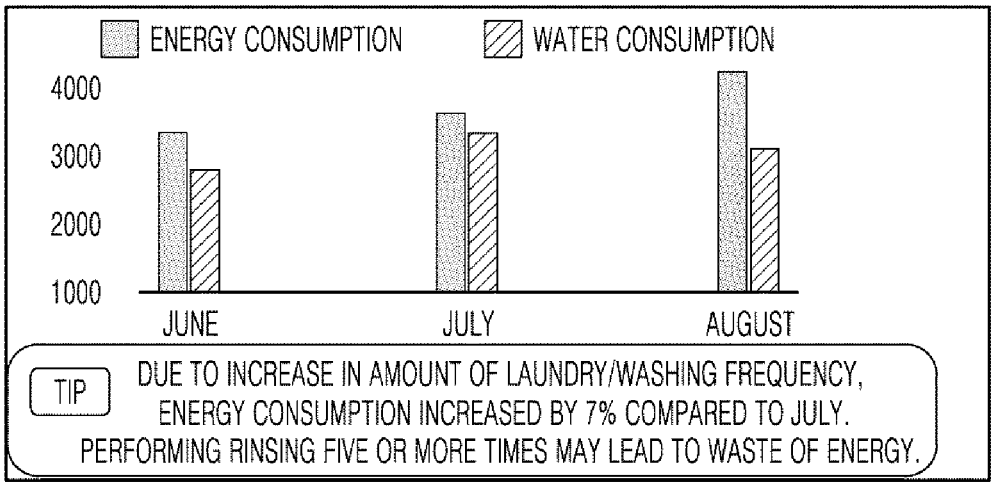

FIGS. 16A to 16C are views each illustrating an example of a washing reporting screen delivered to a user after the operation of the washing machine is completed according to an embodiment of the present disclosure.

According to the example of FIGS. 16A to 16C, it can be seen that, in the washing reporting, the washing amount was 7 kg, the injected detergent amount was 2 cups, the total washing time was 1 hour 35 minutes, and one time of rinsing was added in the operating course of the washing machine.

In addition, the washing reporting may indicate that an amount of detergent more than 10% above the prescribed amount has been injected, and may suggest reducing the amount of detergent or adding one more rinsing.

In addition, the washing reporting may suggest a later washing time and a washing course together with an analysis of the user's washing habits. In addition, the amount of energy consumed and the amount of water consumed while performing the washing may be displayed on a monthly basis to inform the user of an energy consumption and water consumption trend according to the use of the washing machine.

Figure 17:
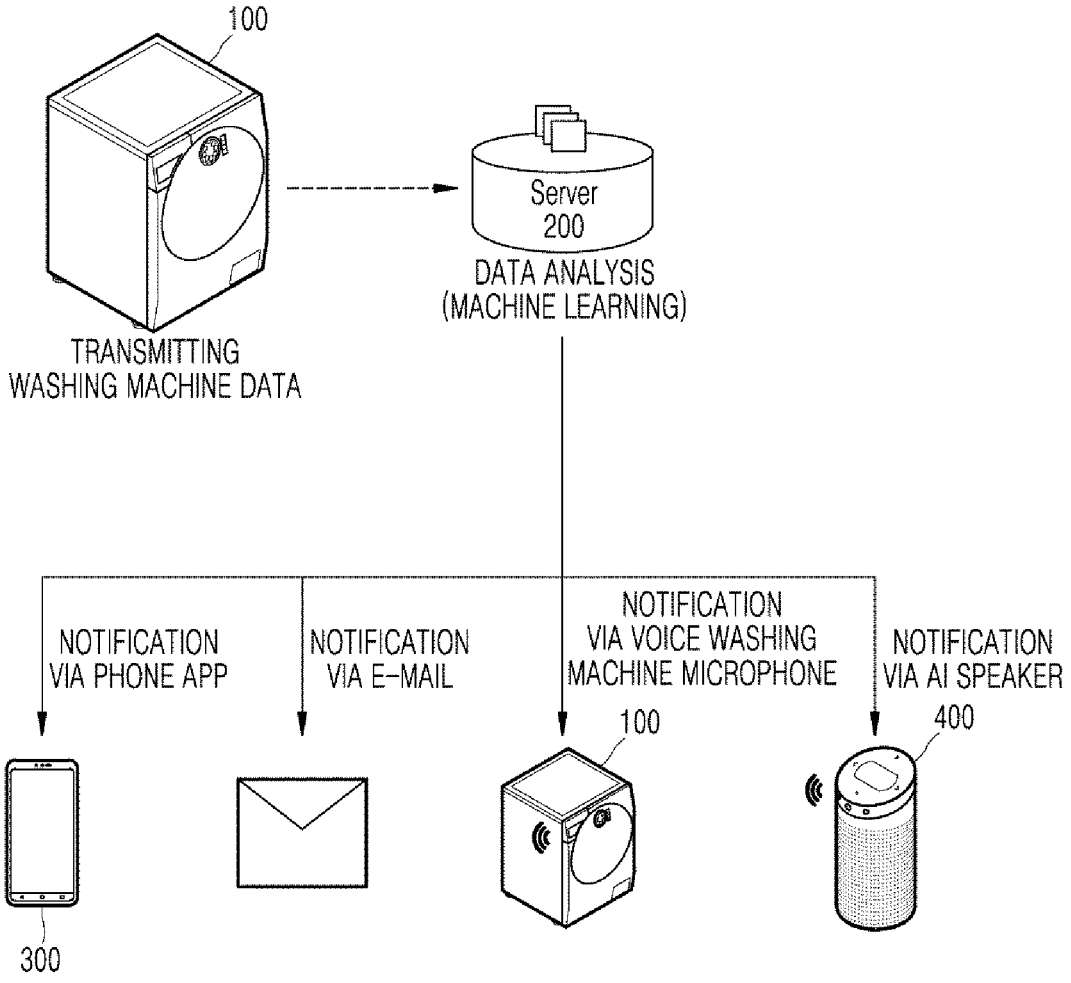
FIG. 17 is a view illustrating an environment in which data generated by a washing machine according to an embodiment of the present disclosure is analyzed and used.

FIG. 17 is a view illustrating an environment in which data generated by a washing machine according to an embodiment of the present disclosure is analyzed and used.

The data generated by the washing machine may be transmitted to the external server 200, and the data may be analyzed through the machine learning model in the external server 200. The first deep neural network, which is a machine learning model, may estimate the type and amount of detergent injected in the washing water or the rinsing water on the basis of the analyzed data.

In addition, the external server 200 may further include a second deep neural network that calculates the amount of detergent and a washing operation method recommended for proper washing according to the accumulated operation records of the washing machine.

The external server 200 may transmit, to the user terminal 300, the operating state of the washing machine and the recommended washing method calculated through the deep neural network model, and may notify the user of the operating state of the washing machine and the recommended washing method calculated using the deep neural network model via e-mail, via a microphone of the washing machine 100, or via the artificial intelligence speaker 400.

In addition, the user may provide feedback on the operation of the washing machine 100 by responding to the notification of the user terminal 300, the washing machine 100, and the artificial intelligence speaker 400.

Figure 18:
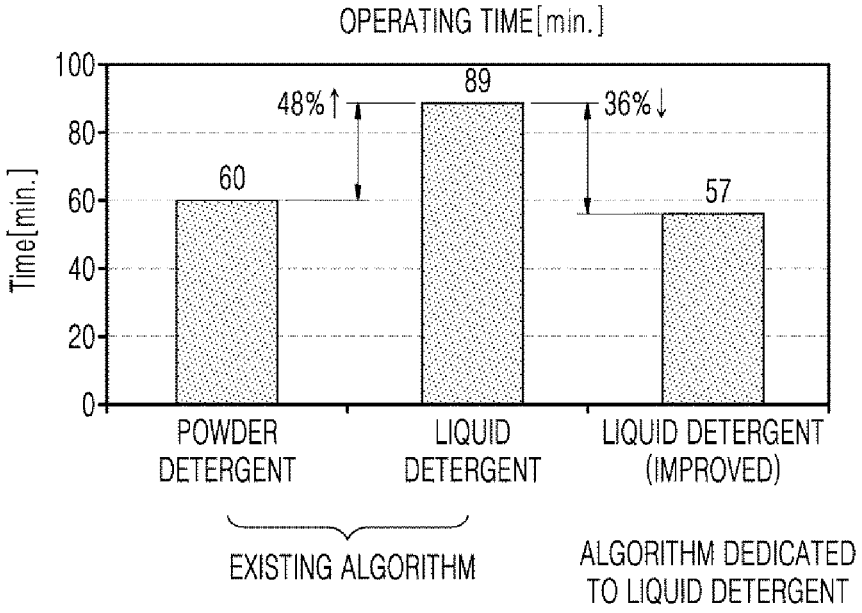
FIG. 18 is a view illustrating the effect of reducing the operation time through a washing machine according to an embodiment of the present disclosure.

FIG. 18 is a view illustrating the effect of reducing the operation time through a washing machine according to an embodiment of the present disclosure.

FIG. 18 shows the effect of reducing the washing operation time specifically when liquid detergent is injected.

It can be seen that the existing algorithm does not accurately determine the type and amount of detergent, and thus the washing time using powder detergent takes 60 minutes, whereas the washing time takes 89 minutes when the same washing operation is performed using liquid detergent. In other words, in the existing algorithm, the operation time is increased by 48% in the case of liquid detergent.

In contrast, it can be seen that the washing machine according to the embodiment of the present disclosure is capable of accurately determining the type and amount of detergent, and thus the operation time is improved to 57 minutes even in the case of liquid detergent.

That is, the washing machine according to the embodiments of the present disclosure is capable of accurately determining the type of detergent initially injected, and operating according to the algorithm dedicated to liquid detergent, thereby enabling efficient washing.

Figure 19:
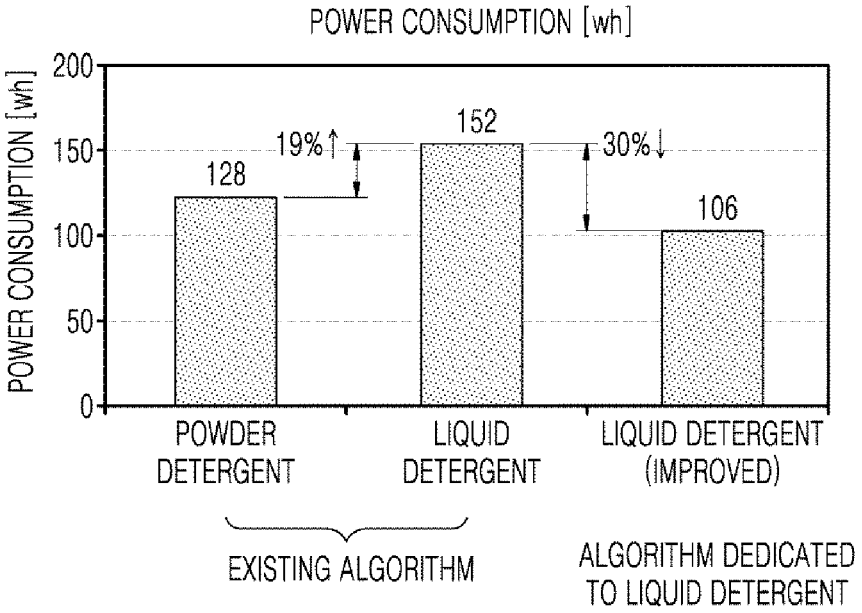
FIG. 19 is a view illustrating a power saving effect through a washing machine according to an embodiment of the present disclosure.

FIG. 19 is a view illustrating a power saving effect through a washing machine according to an embodiment of the present disclosure.

It can be seen that the existing algorithm does not accurately determine the type and amount of detergent, and thus the washing time using powder detergent consumes 128 Wh, whereas the power consumption is 152 Wh when the same washing operation is performed for liquid detergent. In other words, in the existing algorithm, the power consumption is increased by 19% in the case of liquid detergent.

In contrast, it can be seen that the washing machine according to the embodiment of the present disclosure is capable of accurately determining the type and amount of detergent, and thus the power consumption is improved to 106 Wh even in the case of liquid detergent.

That is, the washing machine according to the embodiments of the present disclosure is capable of accurately determining the type of detergent initially injected, and operating according to the algorithm dedicated to liquid detergent, thereby enabling efficient washing.

As described above, the washing machine according to the embodiments of the present disclosure is capable of performing the most effective operation in terms of washing time and washing power consumption, by accurately determining the type and amount of injected detergent and appropriately operating the washing machine accordingly.

The embodiments of the present disclosure described above may be implemented through computer programs executable through various components on a computer, and such computer programs may be recorded in computer-readable media. For example, the recording media may include magnetic media such as hard disks, floppy disks, and magnetic media such as a magnetic tape, optical media such as CD-ROMs and DVDs, magneto-optical media such as floptical disks, and hardware devices specifically configured to store and execute program commands, such as ROM, RAM, and flash memory.

Meanwhile, the computer programs may be those specially designed and constructed for the purposes of the present disclosure or they may be of the kind well known and available to those skilled in the computer software arts. Examples of program code include both machine codes, such as produced by a compiler, and higher level code that may be executed by the computer using an interpreter.

As used in the present application (especially in the appended claims), the terms "a/an" and "the" include both singular and plural references, unless the context clearly conditions otherwise. Also, it should be understood that any numerical range recited herein is intended to include all sub-ranges subsumed therein (unless expressly indicated otherwise) and accordingly, the disclosed numeral ranges include every individual value between the minimum and maximum values of the numeral ranges.

Operations constituting the method of the present disclosure may be performed in appropriate order unless explicitly described in terms of order or described to the contrary. The present disclosure is not necessarily limited to the order of operations given in the description. All examples described herein or the terms indicative thereof ("for example," etc.) used herein are merely to describe the present disclosure in greater detail. Therefore, it should be understood that the scope of the present disclosure is not limited to the example embodiments described above or by the use of such terms unless limited by the appended claims. Also, it should be apparent to those skilled in the art that various alterations, substitutions, and modifications may be made within the scope of the appended claims or equivalents thereof.

Therefore, technical ideas of the present disclosure are not limited to the above-mentioned embodiments, and it is intended that not only the appended claims, but also all changes equivalent to claims, should be considered to fall within the scope of the present disclosure.

What is claimed is:

1. A washing machine comprising:

a first tub into which laundry is loaded;

a water supplier configured to supply washing water to the first tub;

a detergent detection sensor configured to detect a first conductivity and a first turbidity of the washing water after the washing water is supplied to the first tub; and a processor configured to determine a first washing cycle for the washing machine based on an amount of laundry loaded into the first tub, wherein the processor is further configured to determine a type and amount of detergent injected in the washing water based on the detected first conductivity and first turbidity of the washing water, and determine a second washing cycle for the washing machine based on the determined type and amount of the detergent.

2. The washing machine of claim 1, wherein the detergent detection sensor is further configured to detect a first temperature of the washing water, and correct the first conductivity and the first turbidity of the washing water based on the detected first temperature, and wherein the processor is further configured to determine the type and amount of the detergent injected in the washing water based on the corrected first conductivity and first turbidity of the washing water.

3. The washing machine of claim 1, further comprising a weight sensor configured to detect the amount of the laundry loaded into the first tub.

4. The washing machine of claim 3, wherein the processor is configured to generate a signal that requests additional detergent based on the determined amount of the detergent being less than a threshold, wherein the threshold varies based on the amount of the laundry detected by the weight sensor.

5. The washing machine of claim 1, further comprising a second tub configured to accommodate the first tub, wherein the first tub has an opening on its surface and is rotatably coupled to the second tub, and wherein the detergent detection sensor penetrates through the second tub to contact the washing water in the second tub.

6. The washing machine of claim 2, wherein the determining of the type and amount of the detergent injected in the washing water is performed by applying the detected first conductivity and first turbidity to a first neural network model, and wherein the first neural network model has been previously trained using training data that comprises conductivity and turbidity measured in a solution, and a type and an amount of detergent that should be injected in the solution.

7. The washing machine of claim 2, wherein the processor is further configured to determine a rinsing cycle based on the determined type of detergent.

8. The washing machine of claim 7, wherein the detergent detection sensor is further configured to detect a second conductivity and a second turbidity of rinsing water during the rinsing cycle, and wherein the processor is further configured to estimate a state of the rinsing water based on the detected second conductivity and second turbidity, and to adjust the rinsing cycle based on the estimated state of the rinsing water.

9. The washing machine of claim 8, wherein the detergent detection sensor is further configured to detect a third conductivity and a third turbidity of the rinsing water during the adjusted rinsing cycle, and wherein the processor is further configured to determine a rinsing performance based on a difference between the second conductivity and the third conductivity of the rinsing water, and a difference between the second turbidity and the third turbidity of the rinsing water.

10. The washing machine of claim 9, wherein the processor is further configured to, after the rinsing cycle is completed:

estimate a degree of rinsing based on the determined rinsing performance; and transmit information of the estimated degree of rinsing to a user terminal, and adjust the rinsing cycle based on a signal received from the user terminal in response to the transmitted information.

11. The washing machine of claim 1, wherein the detergent detection sensor is configured to detect the first conductivity and the first turbidity of the washing water immediately after the washing water is supplied to the first tub.

12. A method of controlling a washing machine, the method comprising:

detecting an amount of laundry loaded into a first tub of the washing machine;

supplying washing water to the first tub;

determining, by a processor, a first washing cycle for the washing machine based on the detected amount of laundry;

detecting, by a detergent detection sensor, a first conductivity and a first turbidity of the washing water after the washing water is supplied to the first tub;

determining, by the processor, a type and amount of detergent injected in the washing water based on the detected first conductivity and first turbidity of the washing water; and determining, by the processor, a second washing cycle for the washing machine based on the determined type and amount of the detergent.

13. The method of claim 12, further comprising:

detecting a first temperature of the washing water; and correcting the first conductivity and the first turbidity of the washing water based on the detected first temperature, wherein the determining of the type and amount of the detergent injected in the washing water comprises determining the type and amount of the detergent injected in the washing water based on the corrected first conductivity and the first turbidity of the washing water.

14. The method of claim 12, further comprising generating a signal that requests additional detergent based on the determined amount of the detergent being less than a threshold, wherein the threshold varies based on the amount of the laundry.

15. The method of claim 12, wherein the determining of the type and amount of the detergent injected in the washing water is performed by applying the detected first conductivity and first turbidity to a first neural network model, and wherein the first neural network model has been previously trained using training data that comprises conductivity and turbidity measured in a solution, and a type and an amount of detergent injected in the solution.

16. The method of claim 12, further comprising:

draining the washing water; and determining a rinsing cycle based on the type of the detergent.

17. The method of claim 16, further comprising, after the determining of the rinsing cycle:

supplying rinsing water into the first tub;

detecting a second conductivity and a second turbidity of the rinsing water during the rinsing cycle;

estimating a state of the rinsing water based on the detected second conductivity and second turbidity; and adjusting the rinsing cycle based on the estimated state of the rinsing water.

18. The method of claim 17, further comprising:

detecting a third conductivity and a third turbidity of the rinsing water during the adjusted rinsing cycle; and determining a rinsing performance based on a difference between the second conductivity and the third conductivity of the rinsing water, and a difference between the second turbidity and the third turbidity of the rinsing water.

19. The method of claim 18, further comprising:

estimating a degree of rinsing based on the determined rinsing performance;

transmitting information of the estimated degree of rinsing to a user terminal; and adjusting the rinsing cycle based on a signal received from the user terminal in response to the transmitted information.

20. The method of claim 19, further comprising:

accumulating washing machine operation information obtained during the performing of washing cycles, rinsing cycles, and dehydration cycles; and outputting a suggestion that relates to at least one of the amount or the type of the detergent based on the accumulated washing machine operation information, wherein the washing machine operation information comprises at least one of a washing machine operation time in each cycle, the amount and type of detergent injected into the washing water, or the amount of the laundry.

* * * * *